US009895748B2

(12) United States Patent
Katter

(10) Patent No.: US 9,895,748 B2
(45) Date of Patent: Feb. 20, 2018

(54) ARTICLE FOR MAGNETIC HEAT EXCHANGE AND METHOD OF MANUFACTURING THE SAME

(71) Applicant: VACUUMSCHMELZE GMBH & CO. KG, Hanau (DE)

(72) Inventor: Matthias Katter, Alzenau (DE)

(73) Assignee: VACUUMSCHMELZE & GMBH & CO. KG, Hanau (DE)

( * ) Notice: Subject to any disclaimer, the term of this patent is extended or adjusted under 35 U.S.C. 154(b) by 426 days.

(21) Appl. No.: 14/541,956

(22) Filed: Nov. 14, 2014

(65) Prior Publication Data

US 2016/0167134 A1 Jun. 16, 2016

Related U.S. Application Data

(62) Division of application No. 12/526,669, filed on Oct. 14, 2009, now abandoned.

(51) Int. Cl.

| | |
|---|---|
| ***H01F 41/02*** | (2006.01) |
| ***B22F 3/23*** | (2006.01) |
| ***C22C 38/02*** | (2006.01) |
| ***C22C 38/00*** | (2006.01) |
| ***H01F 1/01*** | (2006.01) |
| ***B22F 3/10*** | (2006.01) |

(52) U.S. Cl.

CPC ..... *B22F 3/23* (2013.01); *B22F 3/101* (2013.01); *C22C 38/002* (2013.01); *C22C 38/005* (2013.01); *C22C 38/02* (2013.01); *H01F 1/015* (2013.01); *B22F 2998/10* (2013.01); *B22F 2999/00* (2013.01); *C22C 2202/02* (2013.01)

(58) Field of Classification Search

CPC ..... B22F 2201/10; B22F 2201/20; B22F 1/0003; C22C 38/002; C22C 38/005

USPC ..... 148/301

See application file for complete search history.

(56) References Cited

U.S. PATENT DOCUMENTS

| | | | | |
|---|---|---|---|---|
| 3,564,520 A * | 2/1971 | Michaud et al. | G11B 5/29 | 360/129 |
| 4,252,671 A * | 2/1981 | Smith | B01J 23/745 | 430/286.1 |
| 5,580,396 A * | 12/1996 | Fruchart | B22F 9/023 | 148/101 |
| 7,563,330 B2 * | 7/2009 | Tsuji | H01F 1/015 | 148/101 |
| 2006/0076084 A1 * | 4/2006 | Nakajima | B22D 11/001 | 148/101 |

FOREIGN PATENT DOCUMENTS

| | | |
|---|---|---|
| JP | 2002069596 A | 3/2002 |
| JP | 2005036302 A | 2/2005 |

OTHER PUBLICATIONS

U.S. Appl. No. 12/526,669, filed Oct. 14, 2009, Abandoned. Notice of Re-Examination from the SIPO dated Sep. 19, 2014.

* cited by examiner

*Primary Examiner* — Jie Yang

(74) *Attorney, Agent, or Firm* — Dickinson Wright PLLC

(57) ABSTRACT

Method of manufacturing a reactive sintered magnetic article, a composite article comprising a mantle and at least one core and a laminate article comprising two or more composite articles are provided which each comprise $(La_{1-a}M_a)(Fe_{1-b-c-}T_{b-}Y_{-c})_{13-d}X_e$, wherein $0 \le a \le 0.9$, $0 \le b \le 0.2$, $0.05 \le c \le 0.2$, $-1 \le d \le +1$, $0 \le e \le 3$.

26 Claims, 10 Drawing Sheets

ARTICLE FOR MAGNETIC HEAT EXCHANGE AND METHOD OF MANUFACTURING THE SAME

This application is a divisional of U.S. Ser. No. 12/526,669, filed 12 Feb. 2007, the entire contents of which are incorporated herein by reference for all purposes.

BACKGROUND

1. Field

Described herein is an article for magnetic heat exchange, in particular to a sintered magnetic article as well as an article comprising a mantle and at least one sintered magnetic core, and to methods of manufacturing them. Devices incorporating these articles are also disclosed.

2. Description of Related Art

The magnetocaloric effect describes the adiabatic conversion of a magnetically induced entropy change to the evolution or absorption of heat. Therefore, by applying a magnetic field to a magnetocaloric material, an entropy change can be induced which results in the evolution or absorption of heat. This effect can be harnessed to provide refrigeration and/or heating.

Magnetic heat exchange technology has the advantage that magnetic heat exchangers are, in principle, more energy efficient than gas compression/expansion cycle systems. Furthermore, magnetic heat exchangers are environmentally friendly, as ozone depleting chemicals such as CFC's are not used.

Magnetic heat exchangers, such as that disclosed in U.S. Pat. No. 6,676,772, typically include a pumped recirculation system, a heat exchange medium, such as a fluid coolant, a chamber packed with particles of a magnetic refrigerant working material which displays the magnetocaloric effect, and a means for applying a magnetic field to the chamber.

In recent years, materials, such as $La(Fe_{1-a}Si_a)_{13}$, $Gd_5(Si, Ge)_4$, Mn (As, Sb) and MnFe (P, As) have been developed which have a Curie Temperature, Tc, at or near room temperature. The Curie Temperature translates to the operating temperature of the material in a magnetic heat exchange system. Consequently, these materials are suitable for use in applications such as building climate control, domestic and industrial refrigerators and freezers as well as automotive climate control.

Further developments of these materials have been directed towards optimizing the composition so as to increase the entropy change and to increase the temperature range over which the entropy change occurs. This enables smaller applied magnetic fields to be used to achieve sufficient cooling and a stable refrigeration cycle to be achieved over a larger temperature range.

These measures aim to simplify the design of the heat exchange system as the smaller magnetic fields can be produced by a permanent magnet rather than require an electromagnet or even a superconducting magnet. However, further improvements are desirable to enable a more extensive application of magnetic heat exchange technology.

SUMMARY

Disclosed herein is a magnetic article for a magnetic heat exchange system which can be reliably and cost-effectively produced and which can be produced in a form suitable for use in magnetic refrigeration systems.

Also disclosed herein are methods by which the article may be produced.

In one embodiment is disclosed a reactive sintered magnetic article which comprises one or more phases of $(La_{1-a}M_a)(Fe_{1-b-c}T_bY_c)_{13-d}$, wherein $0 \le a \le 0.9$, $0 \le b \le 0.2$, $0.05 \le c \le 0.2$, $-1 \le d \le +1$. M may be one or more of the elements Ce, Pr, or Nd. T may be one or more of the elements Co, Ni, Mn, Cr. Y may be one or more of the elements Si, Al, As, Ga, Ge, Sn, or Sb.

In another embodiment is discloses a reactive sintered magnetic article having the formula $(La_{1-a}M_a)(Fe_{1-b-c}T_bY_c)_{13-d}X_e$, where e is such that $0 \le e \le 3$, M, T, and Y are as indicated above, and X is one or more of H, B, C, N, Li, and Be. In a more particular embodiment, $0 < e \le 3$. In other words, the atoms of X may be present in the $(La_{1-a}Ma)(Fe_{1-b-c}T_bY_c)_{13-d}$ phase, desirably interstitially in the crystal structure thereof, or may be absent.

In another embodiment is discloses a composite article comprising two or more phases of the reactive sintered magnetic material described herein.

In another embodiment is disclosed a laminated article comprising two or more reactive sintered magnetic articles described herein, optionally with one or more gaps or spacers between the at least two reactive sintered magnetic articles.

In another embodiment is disclosed a heat exchanger comprising one or more reactive sintered magnetic articles described herein.

In another embodiment is disclosed a cooling system comprising one or more reactive sintered magnetic articles described herein.

In another embodiment is disclosed an air conditioning unit comprising one or more reactive sintered magnetic articles described herein.

In another embodiment is disclosed a climate-control device comprising one or more reactive sintered magnetic articles described herein.

In another embodiment is disclosed an industrial, commercial, or domestic freezer, comprising one or more reactive sintered magnetic articles described herein.

In another embodiment is disclosed an article comprising a mantle and a core disposed within the mantle, comprising reactive sintered $(La_{1-a}M_a)(Fe_{1-a-b}T_bY_c)_{13-d}$.

In another embodiment is disclosed a precursor powder mixture comprising a La precursor powder mixture for manufacture of a sintered magnetic article, comprising a La precursor, an Fe precursor and a Y precursor wherein Y is one or more of Si, Al, As, Ga, Ge, Sn, and Sb, each in an amount to provide the stoichiometry for a $(La_{1-a}M_a)(Fe_{1-b-c}T_bY_c)_{13-d}$ magnetocaloric phase, wherein the precursor mixture contains no substantial amount of a $(La_{1-a}M_a)(Fe_{1-b-c}T_bY_c)_{13-d}$ phase wherein M is one or more of Ce, Pr, and Nd, and T is one or more of Co, Ni, Mn, and Cr; and wherein $0 \le a \le 0.9$, $0 \le b \le 0.2$, $0.05 \le c \le 0.2$, $-1 \le d \le +1$.

In another embodiment is discloses a method of manufacturing one or more reactive sintered magnetic articles described herein, comprising: providing the precursor powder mixture described herein, compacting the precursor powder mixture to form a green body, reactive sintering the green body at a temperature of between 1000° C. and 1200° C. for a time between 2 and 24 hours to form a reactive sintered article having at least one phase having a composition of $(La_{1-a}M_a)(Fe_{1-a-b}T_bY_c)_{13-d}$.

In another embodiment is disclosed a method of manufacturing a magnetic composite article comprising: providing a precursor powder mixture described herein, providing a mantle, enveloping the precursor powder in the mantle to form a precursor composite article, reactively sintering the precursor composite article at a temperature of between 1000° C. and 1200° C. for a time of between 2 and 24 hours to form at least one phase having a composition of $(La_{1-a}M_a)$ $(La_{1-a}M_a)$ $(Fe_{1-b-c}T_bY_c)_{13-d}X_e$, wherein M is one or more of Ce, Pr, and Nd; T is one or more of Co, Ni, Mn, and Cr; and Y is one or more of Si, Al, As, Ga, Ge, Sn, and Sb, and wherein $0 \le a \le 0.9$, $0 \le b \le 0.2 \le$, $0.05 \le c \le 0.2$, $-1 \le d+1$, $0 \le e \le 3$.

In another embodiment is disclosed an article comprising: a mantle; and at least one core comprising one or more reaction sintering precursors of $(La_{1-a}M_a)$ $(Fe_{1-b-c}T_bY_c)_{13-d}$, wherein M is one or more of Ce, Pr, and Nd; T is one or more of Co, Ni, Mn, and Cr; and Y is one or more of Si, Al, As, Ga, Ge, Sn, and Sb, wherein $0 \le a \le 0.9$, $0 \le b \le 0.2$, $0.05 \le c \le 0.2$, $-1 \le d \le +1$.

BRIEF DESCRIPTION OF DRAWINGS

Embodiments will now be described with reference to the drawings which are not intended to limit the scope of the appended claims.

DETAILED DESCRIPTION OF SPECIFIC EMBODIMENTS

Figure 1:
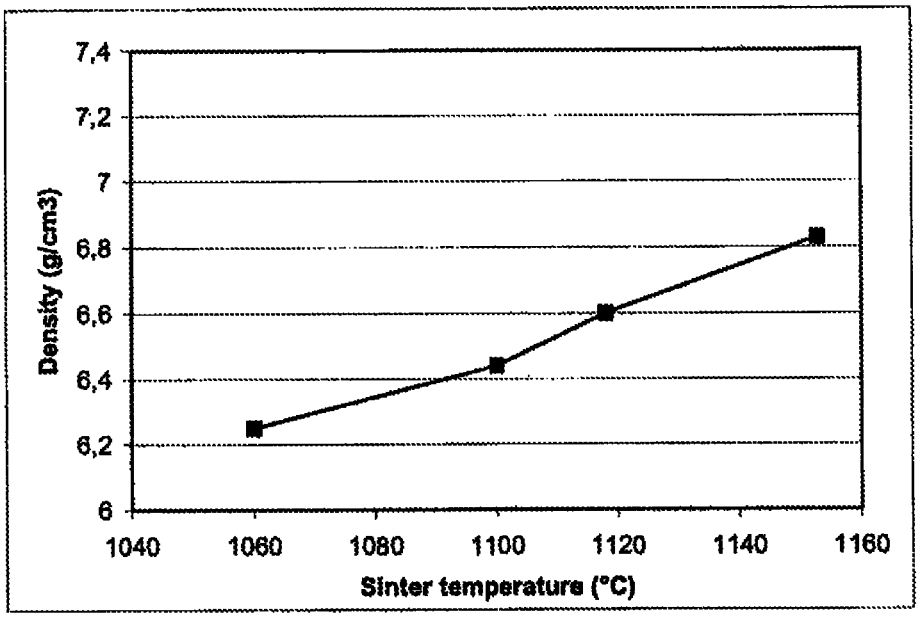
FIG. 1 is a graph that illustrates the relationship between density of the reactive sintered magnetic article and the reactive sintering temperature for an embodiment of the reactive sintered magnetic article disclosed herein.

As used herein the term "reactive sintered" describes an article in which grains are joined to congruent grains by a reactive sintered bond. A reactive sintered bond is produced by heat treating a mixture of precursor powders of differing compositions. The particles of different compositions chemically react with one another during the reactive sintering process to form the desired end phase or product. The composition of the particles, therefore, changes as a result of the heat treatment. The phase formation process also causes the particles to join together to form a sintered body having mechanical integrity.

Reactive sintering differs from conventional sintering since, in conventional sintering, the particles consist of the desired end phase before the sintering process. The conventional sintering process causes a diffusion of atoms between neighbouring particles so as join the particles to one another. The composition of the particles, therefore, remains unaltered as a result of a conventional sintering process.

A reactive sintered magnetic article has the advantage that it can be easily produced using a simple manufacturing process. The magnetocaloric phase is produced directly from the precursor powder after the precursor powder has been pressed into the desired form as a green body. The various precursor powders are provided in appropriate amounts to provide the stoichiometry of the desired phase and may be simply mixed and ground, pressed into a green body having the desired form and reactive sintered to produce the magnetocaloric phase and to form an article having mechanical integrity.

It is known to use conventional sintering to produce a sintered body. However, the known methods are complex, since after a melt casting or melt spinning and homogenization process to form the $(La_{1-a}M_a)$ $(Fe_{1-b-c}T_bY_c)_{13-d}$ phase, a pulverization of the pre-formed material is carried out before a further heat treatment is necessary to sinter the pulverized powder to form an article. Therefore, reactive sintering requires fewer process steps and provides a more cost-effective manufacturing route.

In reactive sintering, the end phase is produced by chemical reaction directly from a mixture of precursor powders of differing composition. This results in the advantage that the reaction and, therefore, the sintering to form the solid body can be carried out at lower temperatures than those required by conventional melt casting, homogenization and conventional sintering of the pre-formed phase. Consequently, a reactive sintered article has the further advantage that the grain size of the article is smaller than that achievable by conventional sintering processes. This smaller grain size results in an improved corrosion resistance and improved mechanical properties for a reactive sintered magnetic article.

The composition of the reactive sintered article may be easily adjusted by adjusting the stoichiometry of the precursor powder. This enables articles of differing composition and magnetocaloric properties to be easily produced using the same manufacturing line.

Furthermore, the reactive sintering process can be simply used to produce a variety of forms such as foils, plates or larger bodies depending on the design of the refrigeration or heat exchange system The restrictions on the size of material which is produced by melt casting methods, and in particular, melt spinning are, therefore, avoided.

The problems associated with the use of particles as the magnetic working material in a magnetic heat exchange system are also avoided by providing a reactive sintered article since the reactive sintered article has mechanical integrity. The operating life of the working material is increased which further increases the ease of use and cost-effectiveness of the magnetic heat exchange system In a particular embodiment, the magnetic sintered article disclosed herein may comprise at least one phase comprising $(La_{1-a}M_a)(Fe_{1-b-c}T_bY_c)_{13-d}$ which has a $NaZn_{13}$-type crystal structure. Depending on the composition, this phase may be cubic or tetragonal and have a Fm3c or I4/mcm space group. The lattice parameters of the $(La_{1-a}M_a)(Fe_{1-b-c}T_bY_c)_{13-d}$ phase vary depending on the composition. For a cubic phase, the a axis lattice parameter may lie in the range 11.1 to 11.5 A. For a tetragonal phase, the a axis lattice parameter may lie in the range 7.8 to 8.1 A and the c axis lattice parameter in the range 11.1 to 11.8 A.

In certain embodiments of the articles described herein the Curie temperature, $T_c$, and, consequently, the operating temperature of the $(La_{1-a}M_a)(Fe_{1-b-c}T_bY_c)_{13-d}$ phase can be adjusted by selecting the substituting elements M and T. For some applications, it is desirable to produce articles comprising a range of Curie temperatures or to produce a range of articles each having a slightly different Curie temperature so as to increase the operating temperature range of the device, The temperature range over which the device can provide heating or cooling is, in turn, increased.

M may be one or more of the elements Ce, Pr and Nd. If M is Ce, then $0 \leq a \leq 0.9$. If M is one or more of the elements Pr and Nd then $0 \leq a \leq 0.5$. Ce reduces the Curie temperature and, consequently, the operating temperature and has the advantage that it is cheaper than La. Pr and Nd substitutions also reduce the Curie temperature.

T may be one or more of the elements Co, Ni, Mn and Cr. These elements also influence $T_c$ and the operating temperature. Mn and Cr lead to a decrease in $T_c$ whereas Co and Ni lead to an increase in $T_c$.

Y may be one or more of the elements Si, Al, As, Ga, Ge, Sn and Sb.

In a particular embodiment, the reactive sintered article may also further comprise $X_e$, wherein X is one or more of the elements H, B, C, N, Li and Be. These elements also result in an increase in $T_c$.

The element X may be accommodated at least in part interstitially in the crystal structure of $(La_{1-a}M_a)(Fe_{1-b-c}T_bY_c)_{13-d}$ forming $(La_{1-a}M_a)(Fe_{1-b-c}T_bY_c)_{13-d}X_e$. The parameter e may lie in the range $0 \leq 3$.

In a particular embodiment, the reactive sintered magnetic article comprising $(La_{1-a}M_a)(Fe_{1-b-c}T_bY_c)_{13-d}$ with a composition according to one of these embodiments may also further comprise an oxygen content of between 500 ppm and 8000 ppm.

The reactive sintered magnetic article may comprise at least 80% by volume of one or more phases comprising $(La_{1-a}M_a)(Fe_{1-b-c}T_bY_c)_{13-d}$ and displaying a magnetocaloric effect. The $(La_{1-a}M_a)(Fe_{1-b-c}T_bY_c)_{13-d}$ phase is magnetocalorically active. By increasing the volume percentage of the phase or phases displaying a magnetocaloric effect, the cooling or heating capacity of the article can be increased and the efficiency of the device in which it is used can be increased.

In an embodiment, the article comprises two or more phases comprising reactive sintered $(La_{1-a}M_a)(Fe_{1-b-c}T_bY_c)_{13-d}X_e$, wherein each phase comprises a different $T_c$, The operating temperature or application temperature range of the article can be increased as a result of providing two or more phases with differing $T_c$. In a particular embodiment, these phases may be arranged in layers so that the $T_c$, of the article increases in a direction, for example with height of the article. In another particular embodiment, these phases may be distributed throughout the volume of the article approximately homogeneously.

In a particular embodiment, the average grain size k of the reactive sintered magnetic article may be ≤20 μm, or ≤10 μm. A small average grain size has the advantage that the mechanical strength and corrosion resistance of the article is increased.

In a particular embodiment, the reactive sintered article according to one of the previous embodiments may exhibit a transition from a paramagnetic state to a ferromagnetic state in a magnetic field interval of less than 5000 Oe or less than 500 Oe. In a particular embodiment, the isothermal magnetic entropy change may be at least 5 J/kgK for a magnetic field change from 0 kOe to 16 kOe, which provides a practically useful entropy change at magnetic fields which can be produced by a permanent magnet.

In a particular embodiment, the density of the reactive sintered magnetic article may be at least 6.00 g/cm$^3$. The density may be adjusted by selecting the reactive sintering temperature and/or length of time for which the green body is sintered. For some application an article with a low density may be desirable so that a porous body is provided. The fluid coolant may then flow through the pores increasing the efficiency of the heat transfer from the magnetocaloric materials and the coolant. For some applications, a higher density may be desirable in order to increase the mechanical strength of the article. The density of the article may be between 70% and 100% of the theoretical density of the phase.

In a particular embodiment, the reactive sintered magnetic article may be a component of a heat exchanger, a cooling system, an air conditioning unit for a building or a vehicle, in particular an automobile, or a climate control device for a building or an automobile. The climate control device may be used as a heater in winter and as a cooler in summer by reversing the direction of the fluid coolant or heat exchanger medium. This is particularly advantageous for automobiles and other vehicles as the space available within the chassis for accommodating the climate control system is limited by the design of the vehicle.

In a particular embodiment, the reactive sintered magnetic article may further comprise a protective outer coating. This protective outer coating can be provided to prevent corrosion of the reactive sintered article by the environment, such as the air, and/or the fluid coolant or heat exchange medium of the heat exchanger. The material of the protective outer coating may be selected depending on the environment in which the article is to be used and may comprise a pure metal or a metal alloy or a polymer. The material of the protective outer coating may also be selected to have a high thermal conductivity so as to increase the heat transfer from the magnetocaloric phase to the heat exchange medium. Metals such as Cu, Al, Ni, Sn, and their alloys may be used in the coating.

In a particular embodiment, the reactive sintered magnetic article may further comprise at least one channel in a surface. This channel may be formed in the green body by use of an appropriate die or former or may be introduced into the surface after the reactive sintering process. The channel or channels may be adapted to direct the flow of a heat exchange medium. This may be achieved by selecting both the width and depth of the channel as well as its form and position in the surface of the article.

The channel or channels can increase the contact area between the article and the coolant so as to increase the efficiency of the heat transfer. Furthermore, the channel may be adapted so as to reduced the formation of eddys in the fluid coolant or heat exchange medium and reduce the flow resistance of the coolant so as to improve heat transfer efficiency.

Also disclosed herein is an article comprising a mantle and at least one core. The core comprises reactive sintered $(La_{1-a}M_a)(Fe_{1-b-c}T_bY_c)_{13-d}$, according to one of the embodiments previously described or precursor thereof. The article may be a component of a heat exchanger, magnetic refrigerator, climate control system or cooling system.

The mantle surrounds the core and may comprise a material selected to provide a number of improvements. The mantle may provide mechanical strengthening of the article. This is particularly useful for the embodiment in which the core comprises a precursor of the $(La_{1-a}M_a)$ $(Fe_{1-b-c}T_b Y_c)_{13-d}$ phase which has not yet been reacted to form the desired magnetocaloric $(La_{1-a}M_a)(Fe_{1-b-c}T_bY_c)_{13-d}$ phase. The article can be more simply transported and worked before the reaction sintering process is carried out. Furthermore, the mantle provides a protection against the environment for both the precursor and the reactive sintered material so that the corrosion resistance of the article is improved.

The mantel may comprise two or more layers which may each have different properties. For example, an outer mantle may provide corrosion resistance and an inner mantle provide increased mechanical strength. The mantle may also be chosen to have a high thermal conductivity so as to increase heat transfer from the core to the heat transfer medium in which the article is situated in a heat exchanger.

The mantle may comprise a material with a melting point of greater than 1100° C. so as to enable a reactive sintering process of the core at temperatures up to just below the melting point of the mantle to be carried out.

The mantle may comprise iron or iron-silicon or nickel or steel or stainless steel. Stainless steel has the advantage that it has better corrosion resistance. Iron has the advantage that it is cheaper. An iron-silicon alloy may be selected and positioned adjacent the core to enable a reaction to occur between the core and the iron-silicon. The composition of the precursor of the core may be adjusted accordingly so that the final reactive sintered material of the core has the desired composition of the $(La_{1-a}M_a)(Fe_{1-b-c}T_bY_c)_{13-d}$- based phase.

The article may comprise a plurality of cores which may be embedded in a matrix and enveloped by the mantle. The matrix and the mantle may comprise the same or different materials.

The mantle and matrix, if one is provided, may be plastically deformable. This enables conventional powder-in-tube based processing methods to be used to fabricate the article. The article may be provided in a variety of forms such as a tape or a wire or a plate and may be elongate. The article may also be flexible which enables the article to be formed into a variety of coils and laminates by simple mechanical processes such as winding and bending.

A single elongate article can be formed in which the mantle envelops all sides of the core. This article can be wound in the form of a solenoid or a pancake type coil having a form appropriate for a particular application without the article having to be cut. Cutting the article has the disadvantage that the core is exposed from the mantle in the cut edge and this region may corrode or decompose depending on the stability of the core and the environment to which it is subjected. If a portion of the core is exposed and it is desired to protect it, a further outer protective layer may be provided. This layer may be provided in only the regions of the exposed core or the whole mantle may be coated and sealed by an additional protective layer. The forming process of the article into the desired shape may take place before or after the reactive sintering process.

The article may comprise a plurality of articles each comprising at least one core comprising reactive sintered $(La_{1-a}M_a)(Fe_{1-b-c}T_bY_c)_{13-d}$ or precursor thereof, wherein each article has a different $T_c$ or an overall composition which after reactive sintering to form the $(La_{1-a}M_a)(Fe_{1-b-c}T_bY_c)_{13-d}$-based phase results in a different $T_c$. The $(La_{1-a}M_a)$ $(Fe_{1-b-c}T_bY_c)_{13-d}$-based phase or precursor thereof may also further comprise $X_e$, where $0 \leq e \leq 3$ As disclosed above, the article may also comprise one or more channels in a surface which are adapted to direct the flow of a heat exchange medium These channels are positioned in the surface of the mantle and may be simply produced by plastic deformation of the surface such as pressing or rolling. Alternatively, the channel or channels may be produced by removing material, for example by cutting or milling.

Also disclosed herein is a laminated article comprising a plurality of articles comprising a mantle and at least one core which comprises reactive sintered $(La_{1-a}M_a)(Fe_{1-b-c}T_b Y_c)_{13-d}X_e$ or precursor thereof according to one of the embodiments previously described. This enables larger components to be assembled which have a laminate structure.

In an embodiment, the laminated article further comprises at least one spacer which is positioned between adjacent articles. If the laminated article comprises n articles, it may comprise n−1 spacers so that each inner article of the laminated structure is separated from its neighbours by a spacer. Alternatively, the laminated article may comprise n+1 spacers so that a spacer is positioned adjacent each side of an article.

The spacer provides the laminated article with an open structure so that the heat exchange medium or coolant may flow between layers of the laminate. This increases the crosssectional area of the laminated article and increases the heat transfer from the laminate to the heat exchange medium.

The spacer may be provided in a variety of forms. In an embodiment, the spacer is an integral part of the article and may be provided by one or more protruding regions of a surface of an article. These protruding regions may be provided by providing one or more depressions in the surface of the article thus creating protrusions in the surface between the depression. In an embodiment, the protruding regions are provided by a plurality of grooves in the surface of the article. The grooves may be generally parallel to one another.

In an embodiment, the spacer is provided as an additional element which is positioned between adjacent layers of the laminate stack. The additional element may be provided by a former. In a further embodiment the spacer is a corrugated tape. The corrugated tape may be positioned between generally flat articles to form a structure similar to that commonly associated with cardboard.

The spacer may comprise $(La_{1-a}M_a)(Fe_{1-b-c}T_bY_c)_{13-d}X_e$ according to one of the embodiment previously described or precursor thereof. This increases the volume of the laminated article which comprises a magnetocalorically active material and increases the efficiency of the heat exchange system.

If a corrugated tape is provided as a spacer, this can conveniently be produced by corrugating portions of the tape or further tapes which are generally similar to those provided as the flat members of the laminated article.

The additional spacer member may provide or be adapted to provide one or more channels adapted to direct the flow of a heat exchange medium This advantageously increases the heat transfer efficiency.

The invention also provides precursor powder for manufacturing a sintered magnetic article, comprising a La precursor, an Fe precursor and a Y precursor in an amount to provide the stoichiometry for a $(La_{1-a}M_a)(Fe_{1-b-c}T_bY_c)_{13-d}X_e$ magnetocaloric phase, wherein the precursor contains no substantial amount of a $(La_{1-a}M_a)(Fe_{-b-c}T_bY_c)_{13-d}X_e$ phase and wherein $0 \le a \le 0.9$, $0 \le b \le 0.2$, $0.05 \le c \le 0.2$, $-1 \le d \le +1$, $0 \le e \le 3$.

The terminology "no substantial amount of a $(La_{1-a}M_a)(Fe_{1-b-c}T_bY_c)_{13-d}X_e$ phase" is defined as, and determined by, the absence of peaks associated with a $(La_{1-a}M_a)(Fe_{1-b-c}T_bY_c)_{13-d}X_e$ phase in a powder X-ray diffraction pattern. In further embodiments, the precursor mixture comprises less than 5 Vol. % of a $(La_{1-a}M_a)(Fe_{1-b-c}T_bY_c)_{13-d}X_e$ phase, less than 1 Vol. % of a $(La_{1-a}M_a)(Fe_{1-b-c}T_bY_c)_{13-d}X_e$ phase and less than 0.1 Vol. % of a $(La_{1-a}M_a)(Fe_{1-b-c}T_bY_c)_{13-d}X_e$ phase.

The sintered magnetic article may be a reactive sintered magnetic article or an article comprising a mantle and at least one core or a laminated article according to one of the embodiments previously described.

The precursors may be selected to provide a stoichiometry for a $(La_{1-a}M_a)(Fe_{1-b-c}T_bY_c)_{13-d}X_e$. magnetocaloric phase according to one of the embodiments previously described.

The precursor compound may be provided in a form or having a composition which enables it to be more easily crushed during the mixing and crushing step to provide the precursor powder. The La precursor may be a La hydride, and/or the Fe precursor may be carbonyl iron. In further embodiments, the La precursor and the Fe precursor are provided as a binary precursor or the La precursor and the Y precursor are provided as a binary precursor.

The average particle size of the powder may be less than 20 μm or less than 10 μm or less than 5 μm. This can be varied by varying the crushing, grinding and/or milling conditions.

One embodiment disclosed herein relates to the use of reactive sintering to produce a reactive sintered magnetic article or a component of a heat exchanger cooling system or climate control apparatus comprising $(La_{1-a}M_a)(Fe_{1-b-c}T_bY_c)_{13-d}X_e$ wherein $0 \le a \le 0.9$, $0 \le b \le 0.2$, $0.05 \le c \le 0.2$, $-1 \le d \le +1$, $0 \le e \le 3$, M is one or more of the elements Ce, Pr and Nd, T is one or more of the elements Co, Ni, Mn and Cr, Y is one or more of the elements Si, Al, As, Ga, Ge, Sn and Sb and X is one or more of the elements H, B, C, N, Li and Be.

Another embodiment disclosed herein relates to a method of manufacturing a reactive sintered magnetic article comprising: providing the precursor powder mixture according to one of the embodiments previously described; compacting the precursor powder mixture to form a green body, and sintering the green body at a temperature of between 1000° C. and 1200° C. for a time of between 2 and 24 hours to form at least one phase having a composition of $(La_{1-a}M_a)(Fe_{1-b-c}T_bY_c)_{13-d}X_e$.

The one or more phases comprising $(La_{1-a}M_a)(Fe_{1-b-c}T_bY_c)_{13-d}X_e$ are formed by reaction of the precursor powder particles. At the same time, the particles are joined together to form a solid article. The two steps of phase formation and sintering take place during the same heat treatment in contrast to the methods in which an alloy comprising $(La_{1-a}M_a)(Fe_{1-b-c}T_bY_c)_{13-d}X_e$ is produced by melt casting or melt spinning, homogenized by heat treatment, pulverized, pressed to form a green body and sintered. Consequently, the method according to the invention is much simpler and easier to carry out.

Furthermore, the sintering time for forming the one or more $(La_{1-a}M_a)(Fe_{1-b-c}T_bY_c)_{13-d}X_e$. phases is at most 24 hours. This method is, therefore, much quicker than methods based on a melt and homogenize approach which typically require a homogenization heat treatment of several hundred hours simply to homogenize the as cast alloy and to form the $(La_{1-a}M_a)(Fe_{1-b-c}T_bY_c)_{13-d}X_e$ phase. With the melt and homogenize approach, a further heat treatment is carried out to sinter the pulverized phase to form a sintered body.

In an embodiment, the La precursor and Fe precursor are provided as a binary precursor which is fabricated by book-molding or strip casting. In a further embodiment, the La precursor and Y precursor are provided as a binary precursor which is fabricated by book-molding or strip casting. These binary precursors have the advantage that they are be produced with relatively high purity and are easy to pulverize so as to produce a precursor powder having a small average particle size and narrow particle size distribution. This improves the homogeneity of the green body as well as of the reactive sintered article.

The green body may be sintered to a density of at least 90% of the theoretical density by adjusting the temperature and sintering time. The optimum temperature and time may depend on the composition of the precursor powder as well as on the average particle size and composition of the component precursor powders and is selected accordingly.

In an embodiment, the green body is sintered at a temperature of less than 1150° C. A sintering temperature below 1150° C. results in an article with a smaller grain size which may further improve the mechanical stability and corrosion resistance. The sintering conditions may be selected so as to produce an average grain size of the article of less than 20 μm or less than 10 μm after the sintering process has been carried out.

The sintering may be carried out in two stages, wherein the first stage is carried out under vacuum and the second stage in inert gas. Inert gas includes the gases argon and hydrogen. The atmosphere under which the sintering takes place may be used to adjust the oxygen content of the final sintered article. The inert gas, in particular Ar, may also include a selected proportion of oxygen to provide a selected oxygen partial pressure.

In an embodiment, at least 50% of the sintering time is carried out under vacuum. In a further embodiment, at least 80% of the sintering time is carried out under vacuum.

In an embodiment, a two stage sintering process is carried out. The first stage is carried out at a sintering temperature which is 0° C. to 100° C. higher than the sintering temperature of the second stage. For example, in the first stage the sintering temperature may be between 1150° C. and 1200° C. and in the second stage the sintering temperature is between 1100° C. and 1150° C., the sintering temperature of the first stage being 0° C. to 100° C. higher than that of the second stage. This first stage may be carried out for up to 12 hours and the total sintering time may be in the range from 2 hours to 24 hours.

The precursor powder may be produced by mixing the precursors and reducing the average particle size of the precursors. This can be performed by jet-milling for example. Before mixing the precursors, at least one precursor may be loaded with hydrogen. This is useful if a hydride is formed as a result of the hydrogen loading which can be more easily pulverized. Also, this process may be used to reduce or remove undesired elements such as oxygen from the precursor.

In some embodiments, the $(La_{1-a}M_a)(Fe_{1-b-c}T_bY_c)_{13-d}$ phase further comprises the element X, where X is H, C, B and/or O, which may be accommodated in the crystal structure interstitially in amount e where $0 \leq e \leq 3$. These elements may be added or their amount adjusted in method steps after the formation of the precursor powder.

In an embodiment, during the sintering process H, B, C and/or O are introduced into the sintered magnetic article. This can be carried out by adjusting the composition of the gas in a portion or during the whole of the sintering process.

Alternatively, or in addition, H, B, C and/or O may be introduced into the sintered magnetic article after the sintering process. These elements may then be introduced into the crystal structure of a pre-formed $(La_{1-a}M_a)(Fe_{1-b-c}T_b Y_c)_{13-d}$ phase. The article may be subjected to a further treatment in a H, B, C and/or O containing atmosphere. This further treatment may be carried out at a temperature from 20° C. to 500° C. at a pressure of 1 mbar to 10 bar for 0.1 to 100 hours. This heat treatment is carried out at much lower temperatures than the sintering process.

After the production of the sintered magnetic article, at least one channel may be introduced into a surface of the sintered magnetic article. The channel may be introduced by sawing or spark cutting.

Alternatively, or in addition, at least one channel may be formed in the green body by use of an appropriately dimensioned die.

After the production of the sintered magnetic article, the article may be coated with a protective layer to provide protection against corrosion due to reactions of the sintered magnetic article with the atmosphere or the heat exchange medium. The protective coating may be applied by conventional processes such as galvanic deposition, dipping or spraying.

Also disclosed herein is a method of manufacturing a magnetocalorically active composite article comprising:

providing the precursor powder mixture of one of the embodiments previously described;

providing a mantle;

enveloping the precursor powder in the mantle to form a precursor composite article, and sintering the precursor composite article at a temperature of between 1000° C. and 1200° C. for a time of between 2 and 24 hours to form at least one phase having a composition of $(La_{1-a}M_a)(Fe_{1-b-c}T_bY_c)_{13-d}X_e$.

The precursor powder which is enveloped in the mantle may be compacted to form a compact or may have the form of a loose powder. This compact may be formed separately from the mantle or may be formed by compacting powder layer by layer in the mantle.

The mantle may be provided in a variety of forms. The mantle may be a tube or may be provided as a generally flat envelope which is open on at least one side or as two plates or foils.

The optimum reactive sintering temperature and time may be influenced not only by the composition and particle size of the precursor powder but also by the composition of the mantle. The optimum sintering conditions for a composite article may differ from those for a reactive sintered article without a mantle.

The precursor composite article may be subjected to a mechanical deformation process before reactive sintering is carried out. The mechanical deformation process increases the size of the precursor composite article as well as increasing the density of the precursor powder. It is desirable that the mechanically deformed precursor composite article has a high fill factor of the precursor powder which provides the magnetocalorically active component so as to provide greater cooling capacity for a composite article of a given size. The precursor composite article may be mechanically deformed by one or more conventional processes such as rolling, swaging and drawing.

Multistage stage deformation/reactive sintering processes may also be carried out. The precursor composite article may undergo a first mechanical deformation process or processes, undergo a first reactive sintering heat treatment partially reacting the precursor powder, undergo a second mechanical deformation process and then undergo a second reactive sintering heat treatment. In principle, any number of reactive sintering and mechanical deformation process is can be carried out.

One or more intermediate annealing heat treatments may also be carried out during the mechanical deformation process or processes in order to soften the mantle and, depending on the relative hardnesses and annealing behaviour of the precursor powder in relation to the mantle, the precursor powder as well. The annealing heat treatment simply softens the metals and/or alloys and substantially no chemical reaction to form the magnetocalorically active phase takes place during these annealing heat treatments. An annealing heat treatment is typically carried out at around 50% of the melting temperature of the material.

After the precursor is enveloped in the mantle, the mantle may be sealed. This may be achieved by welding the seams or by plugging the ends of a tube possibly with an additional welding step to join the plugs and tube. The precursor composite article may be subjected to a degassing heat treatment before the mantle is sealed so as to remove undesired water, hydrogen and oxygen, for example.

At least one channel may be introduced into a surface of the composite article. The channel may be introduced into a surface of the precursor composite article before the sintering process is carried out. The one or more channels may be introduced by plastic deformation of at least one surface of the precursor composite article. This may be achieved by profile rolling, for example.

The least one channel may be introduced into a surface of the composite article after the sintering process has been carried out. Similar methods to those previously described may be used.

The precursor composite article may be sintered at a temperature, time and under an atmosphere as previously described for the reactive sintered article.

The invention also relates to methods of manufacturing a laminated article from two or more precursor composite articles according to an embodiment previously described.

A laminated article may be formed by arranging two or more precursor composite articles to form a laminate which may, e.g., have the form of a stack. The articles may be joined together to form a single fixed laminated article. This may be performed by welding or, depending on the subsequent treatments to which the laminate will be subjected, a lower temperature joining technique such as brazing.

The laminated article may be manufactured in a form suitable for use as the active component in a heat exchanger or climate control apparatus for example. This active component may have the form of a fin, for example.

In some embodiments, at least one spacer is provided between adjacent precursor composite articles. In a first embodiment, the spacer is provided by the channel or channels provided in one or more surfaces of the individual articles. As previously described, the channels may be introduced by profile rolling, pressing, spark cutting or milling. The channels allow the heat exchange medium to flow through the laminated article thus improving the contact area between the heat exchange medium and the laminated article and improving the heat transfer characteristics.

In another embodiment, the spacer is provided in the form of an additional element or member which is positioned between adjoining layers of the laminate. The spacer may be provided in the form of spacer blocks or as spokes of a former or in the form of a corrugated tape, for example. A corrugated tape may be fabricated by rolling flat tape between two meshed cogs which have a suitable spacing between the teeth of the two cogs as they mesh. The spacer may itself comprise magnetocalorically active material and may itself be a composite article according to one of the embodiments previously described.

The channels of the laminated article may be arranged so as to direct the flow of the heat exchange medium so as to maximise heat transfer while reducing the currents. In an embodiment, each layer of the laminate comprises an article in which one surface comprises a plurality of generally parallel grooves. The generally parallel grooves of neighbouring layers in the laminate are arranged generally orthogonal to one another. If an additional spacer is used, the spacer positioned between neighbouring layers may also provide channels arranged generally orthogonal to one another.

The laminated article may be assembled before the reactive sintering process is carried out or after the reactive sintering process is carried out.

The laminated article may also be assembled from partially reacted composite articles and the laminate subjected to a final reactive sintering treatment after the articles have been assembled and possibly joined together to form the laminated article. The laminated article may be subjected to pressure during the reactive sintering treatment.

In the specific embodiments described below, reference is made to a phase wherein La, Fe, and Si are present, and the effect of various additions of elements described herein to obtain other phases are presented. These phases are described as "$L_a(F_e\ S_i)_{13}$-based" phases.

Precursor Powder Production

Reactive sintered magnetic articles comprising at least one $La(Fe, Si)_{13}$-based phase were fabricated by the following method. A precursor powder was prepared by providing a lanthanum hydride powder with a grain size of less than around 200 μm (microns), an carbonyl iron powder with an average particle size (FSSS) of 3.5 μm and silicon powder with an average particle size (FSSS) of 2.5 μm The lanthanum hydride precursor powder was fabricated by packing 500 g of metallic lanthanum in iron foil and subjecting the foil to an atmosphere containing a mixture of 0.3 bars of argon and one bar of hydrogen. It was found that, by providing a fresh surface, lanthanum hydride in the form of $LaH_3$ could be readily produced at temperatures as low as room temperature. The lanthanum hydride was ground to a coarse powder having average particle size of less than 200 μm. Lanthanum hydride was used as the lanthanum precursor as its particle size can be easily reduced by milling processes such as jet milling.

The La-hydride, carbonyl iron and silicon powder were weighed out in amounts so as to produce a nominal stoichiometry of $LaFe_{11.8}Si_{1.2}$ and jet milled to produce a fine powder with an average particle size (FSSS) of 2.7 μm.

The composition in weight percent of the starting powder and the fine powder after the milling and mixing process as well as the composition of the reactive sintered article fabricated from this powder are summarised in table 1.

TABLE 1

| Sample | amount | La (wt %) | Si (wt %) | O (wt %) | C (wt %) | N (wt %) |
|---|---|---|---|---|---|---|
| Coarse mixture (target) | 4000 | 19.58 | 4.08 | | | |
| Sump | 1250 | 24.64 | 2.09 | | | |
| Fine powder | 2660 | 17.98 | 3.65 | | | |
| Sintered article | | | | 0.44 | 0.009 | 0.014 |

As can be seen in table 1, the composition of the fine powder has a slightly lower lanthanum and silicon content compared to the initial stoichiometry of the starting powder. The fine powder used to fabricate the reactive sintered magnetic articles had a stoichiometry of $La_{0.94}Fe_{11.89}Si_{1.11}$.

Green Body Production

The precursor powder was used to fabricate a plurality of green bodies. For each green body, 60 grams of the precursor powder was formed and isostatically pressed at a pressure of 2500 bars. The green body was then divided into five parts.

Reactive Sintered Magnetic Article Production

The green bodies were reactive sintered under a variety of conditions and at a variety of temperatures from 1060° C. to 1180° C. for times between 3 hours and 24 hours.

The effect of the reactive sintering temperature on the density of the reactive sintered magnetic article produced was investigated and the results are illustrated in FIG. 1. The sinter density increases from 6.25 g/cm$^3$ to 6.83 g/cm$^3$ as the reactive sintering temperature is increased from 1060° C. to 1150° C. The sample reactive sintered at 1060° C. was found to have a greater porosity than that reactive sintered at 1100° C. The theoretical density of La $Fe_{11.8}Si_{1.1}$ assuming a lattice parameter of 11.48 nm is calculated to be 7.30 g/cm$^3$. The samples investigated have a density of between 85.6% to 93.6% of the theoretical density.

Figure 2:
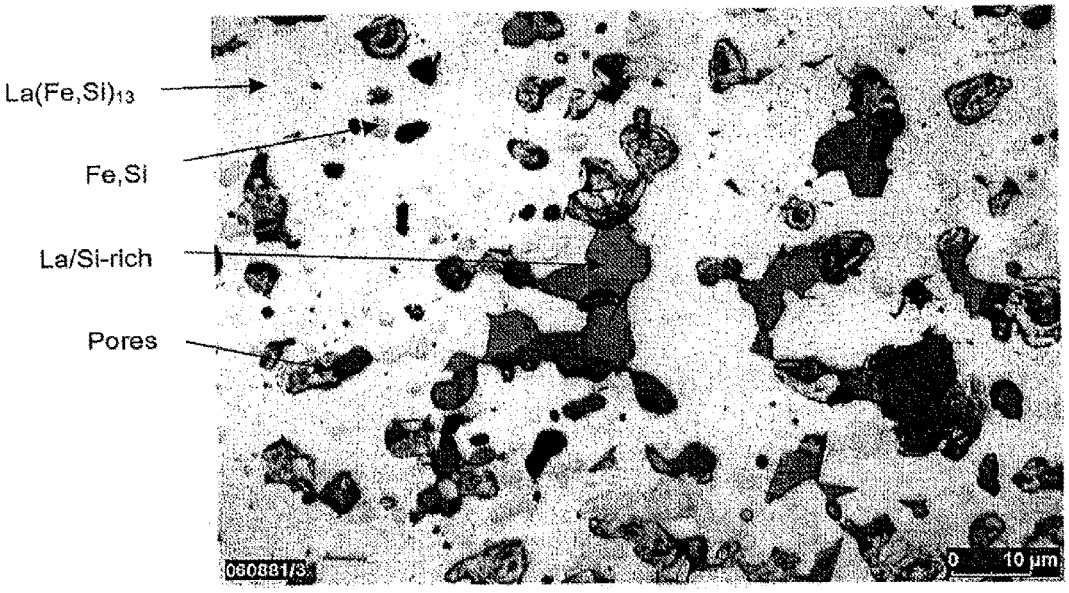
FIG. 2 is an optical micrograph of a polished cross-section of an embodiment of a magnetic article disclosed herein that is reactive sintered at 1060° C. for 4 hours.
Figure 3:
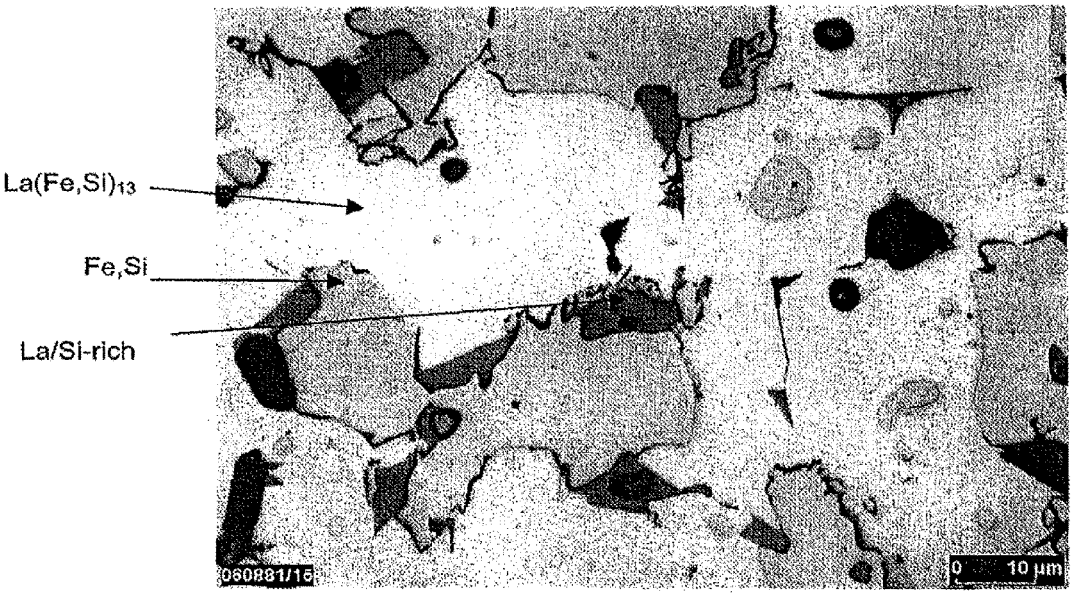
FIG. 3 is an optical micrograph of a polished cross-section of an embodiment of a magnetic article as disclosed herein which was reactive sintered at 1160° C. for 8 hours.

The effect of the reactive sintering temperature on the grain size and phase distribution of the reactive sintered magnetic articles fabricated from the green bodies is illustrated by a comparison of FIGS. 2 and 3.

The composition of the reactive sintered magnetic article illustrated in FIG. 2 was 18 wt % La, 3.65 wt % Si, 0.44 wt % O, rest Fe and of the reactive sintered magnetic article of FIG. 3 was 18.0 wt % La, 3.65 wt % Si, 0.39 wt % O, rest Fe. The compositions of the two articles differ slightly in oxygen content.

FIG. 2 shows an optical micrograph of a polished cross-section of a magnetic article which was reactive sintered at 1060° C. for 4 hours and FIG. 3 shows an optical micrograph of a polished cross-section of a magnetic article reactive sintered at 1160° C. for 8 hours.

As can be seen by a comparison of FIGS. 2 and 3, the grain size was observed to increase with increasing temperature. For temperatures above about 1150° C., the amounts of FeSi and a LaSi-rich phase are found to increase and form as large segregations in the $La(Fe,Si)_{13}$ matrix.

Figure 4A:
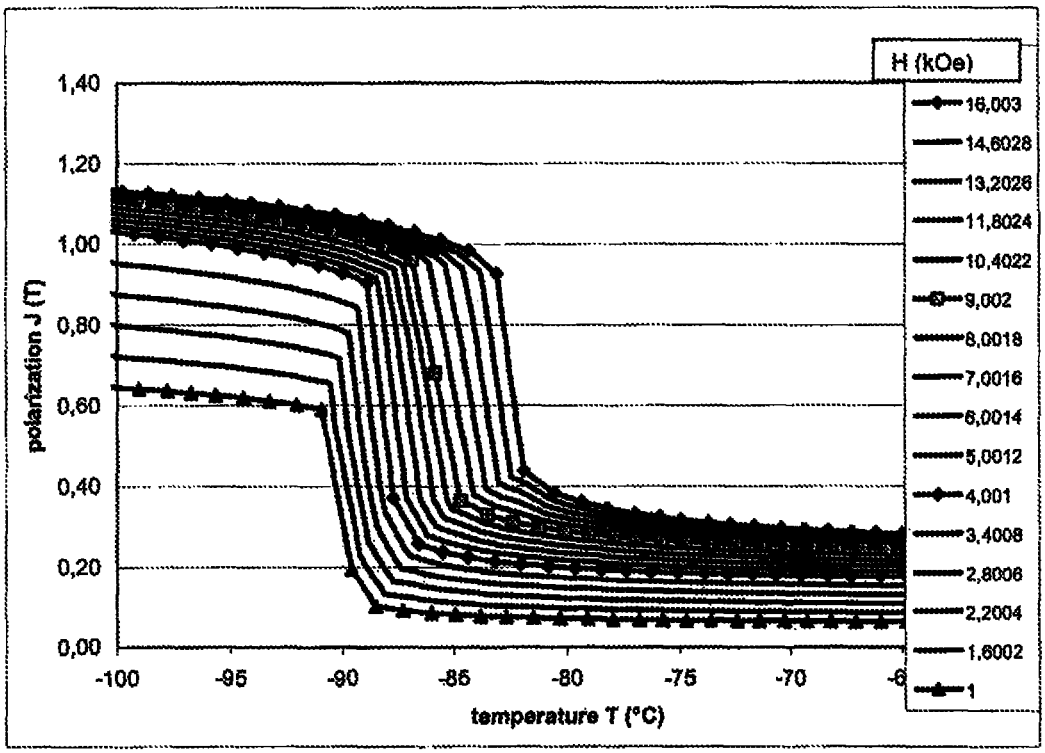
FIG. 4*a* is a graph illustrating the temperature dependence of the polarisation J for an embodiment of a magnetic article disclosed herein that is reactive sintered at 1060° C. for 4 hours.
Figure 4B:
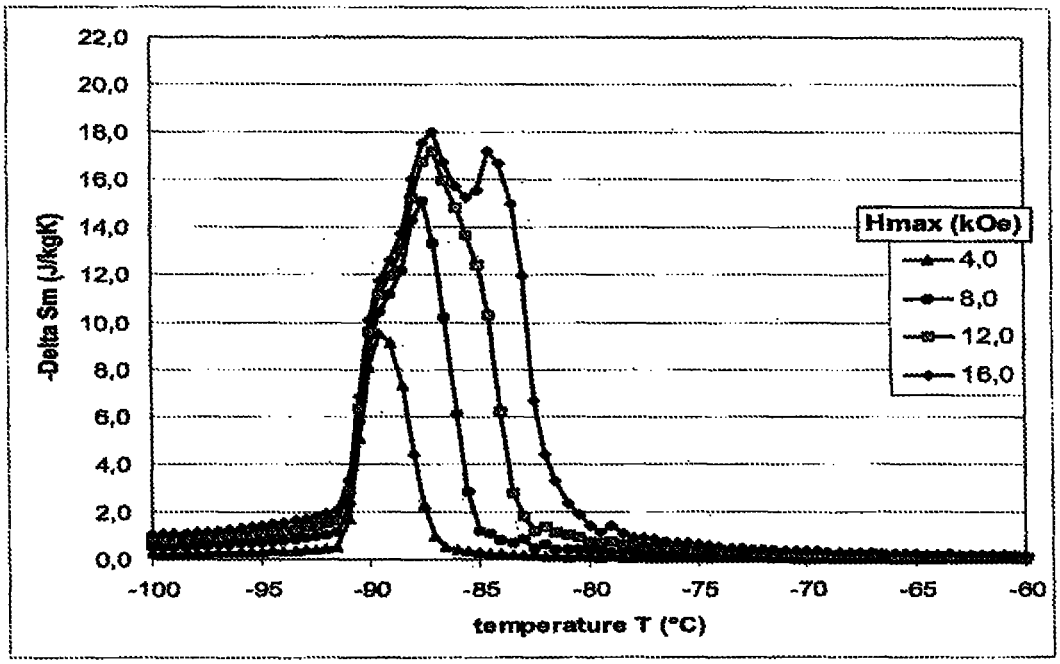
FIG. 4*b* is a graph illustrating the temperature dependence of the entropy change $\Delta S_m$ for the magnetic article of FIG. 4*a*.
Figure 5A:
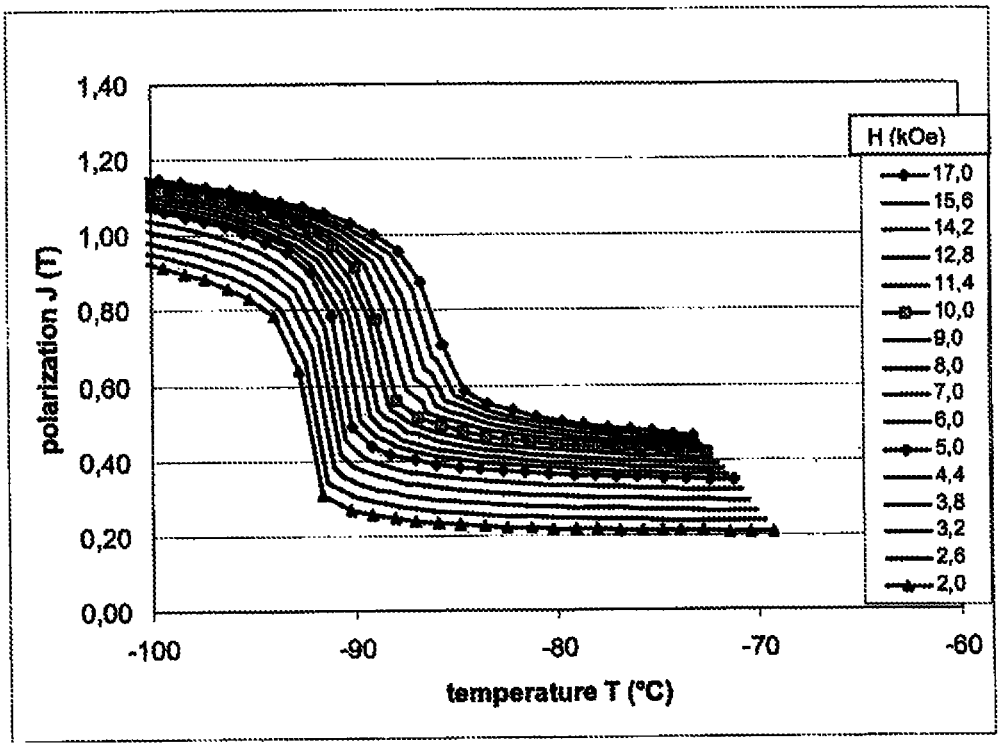
FIG. 5*a* is a graph illustrating the temperature dependence of the polarisation J for an embodiment of a magnetic article disclosed herein that is reactive sintered at 1153° C. for 4 hours.
Figure 5B:
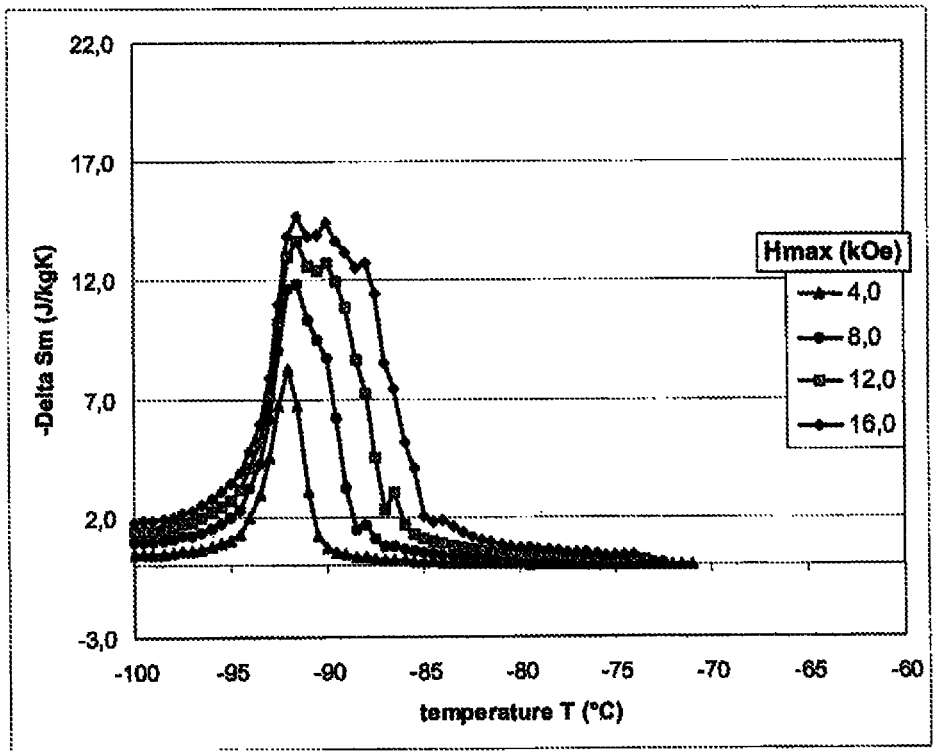
FIG. 5*b* is a graph illustrating the temperature dependence of the entropy change $\Delta S_m$ for the magnetic article of FIG. 5*a*.

The polarization J and entropy change $\Delta S_m$ as a function of temperature was measured for these samples at a variety of applied magnetic fields in the range from 1 kOe to 16 kOe and the results are illustrated in FIGS. 4 and 5 respectively. For a reactive sintering temperature of 1060° C. and an applied magnetic field of 12 kOe, a maximum entropy change $\Delta S_m$ of around 17 J/kgK was measured. For a sintering temperature of 1153° C. and an applied magnetic field of 12 kOe, the maximum entropy change $\Delta S_m$ is reduced to around 14 J/kgK. The formation of the secondary phases may lead to a reduction in the maximum entropy change measured as illustrated by a comparison of FIGS. 4 and 5.

Further experiments revealed that the effect of the phase segregation observed in articles sintered at temperatures of above about 1150° C. can be reversed by carrying out a further heat treatment at a lower temperature. This is illustrated by a comparison of FIGS. 6 and 7.

Figure 6A:
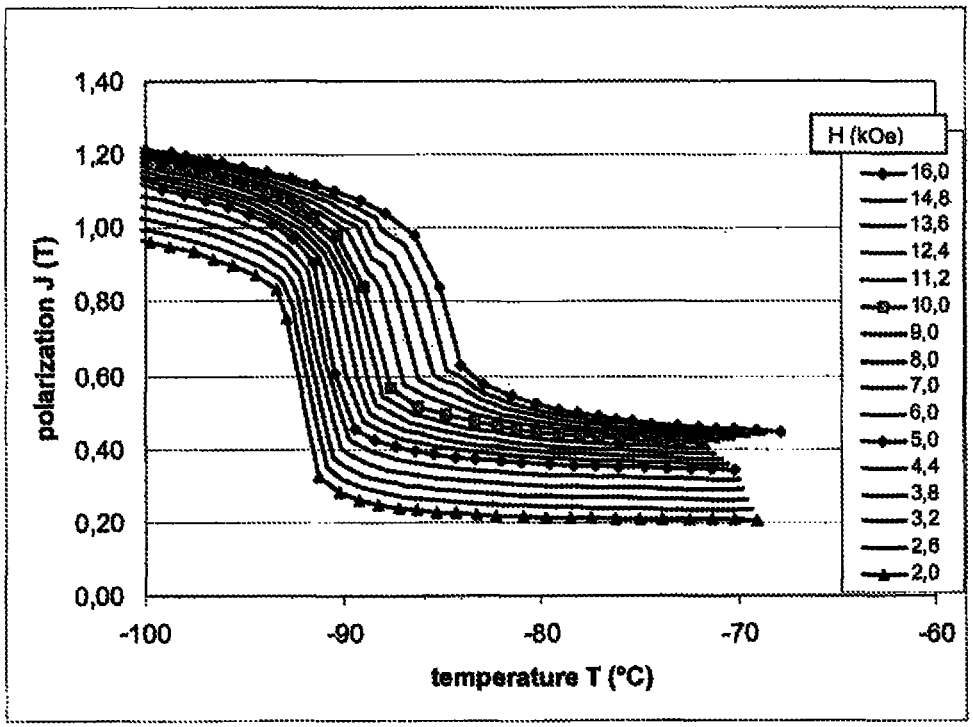
FIG. 6*a* is a graph illustrating the temperature dependence of the polarisation J for an embodiment of a magnetic article disclosed herein that is reactive sintered at 1140° C. for 8 hours.
Figure 6B:
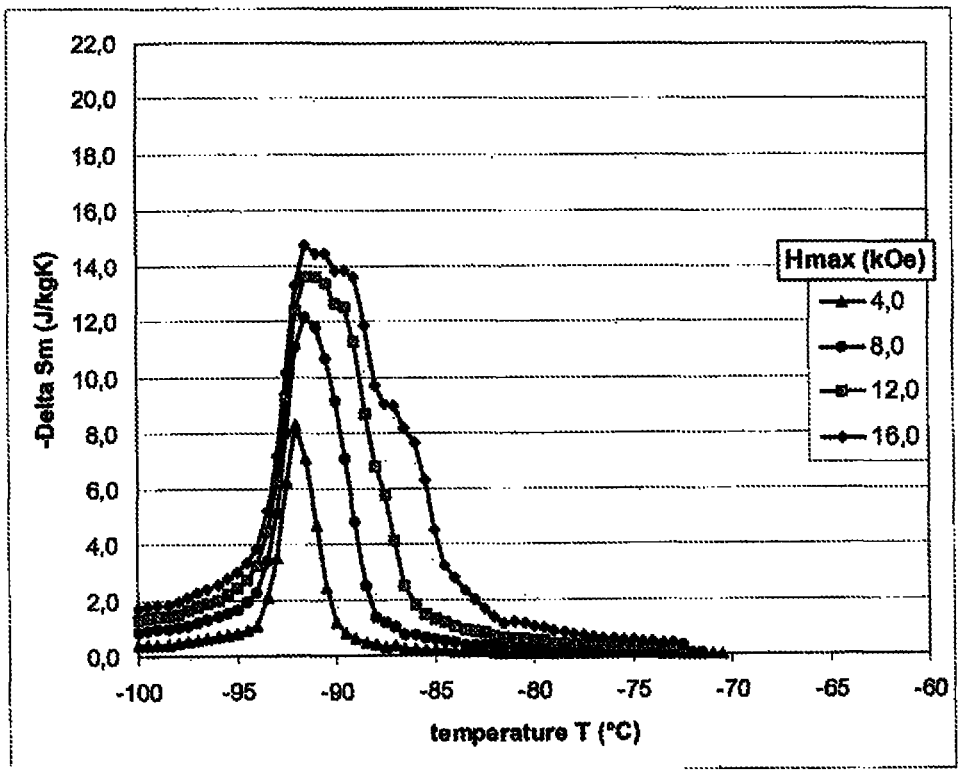
FIG. 6*b* is a graph illustrating the temperature dependence of the entropy change $\Delta S_m$ for the magnetic article of FIG. 6*a*.

FIG. 6*a* shows a diagram illustrating the temperature dependence of the polarisation J at different applied magnetic fields in the range 1 kOe to 16 kOe for a magnetic article reactive sintered at 1140° C. for 8 hours and FIG. 6*b* shows a diagram illustrating the temperature dependence of the entropy change $\Delta S_m$ at different applied magnetic fields in the range 1 kOe to 16 kOe for the magnetic article of FIG. 6*a*.

Figure 7A:
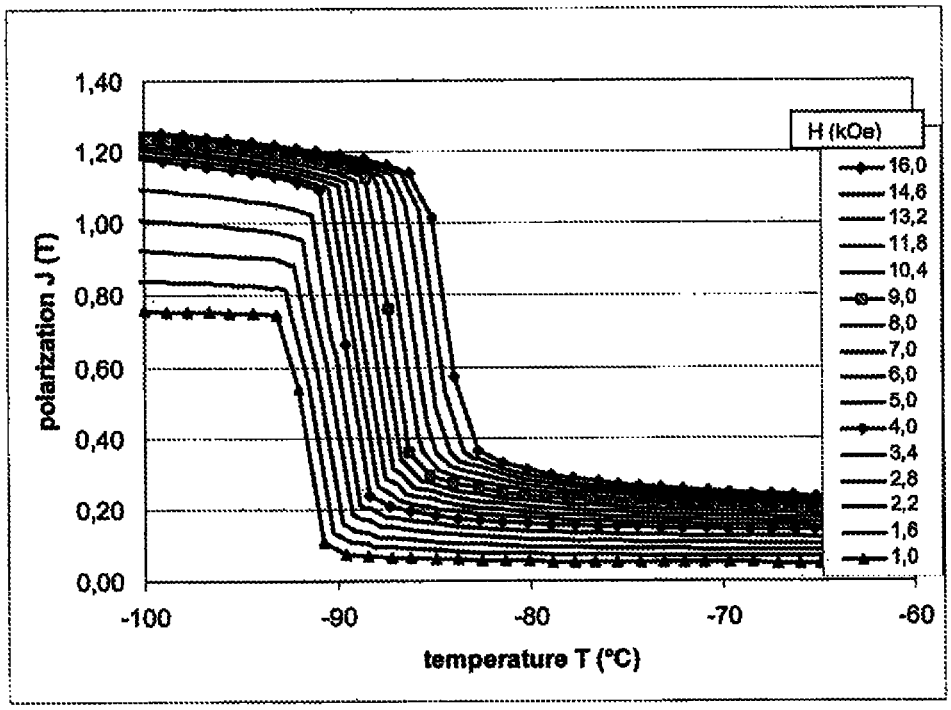
FIG. 7*a* is a graph illustrating the temperature dependence of the polarisation J for an embodiment of a magnetic article disclosed herein that is reactive sintered at 1140° C. for 8 hours and at 1100° C. for 11 hours.
Figure 7B:
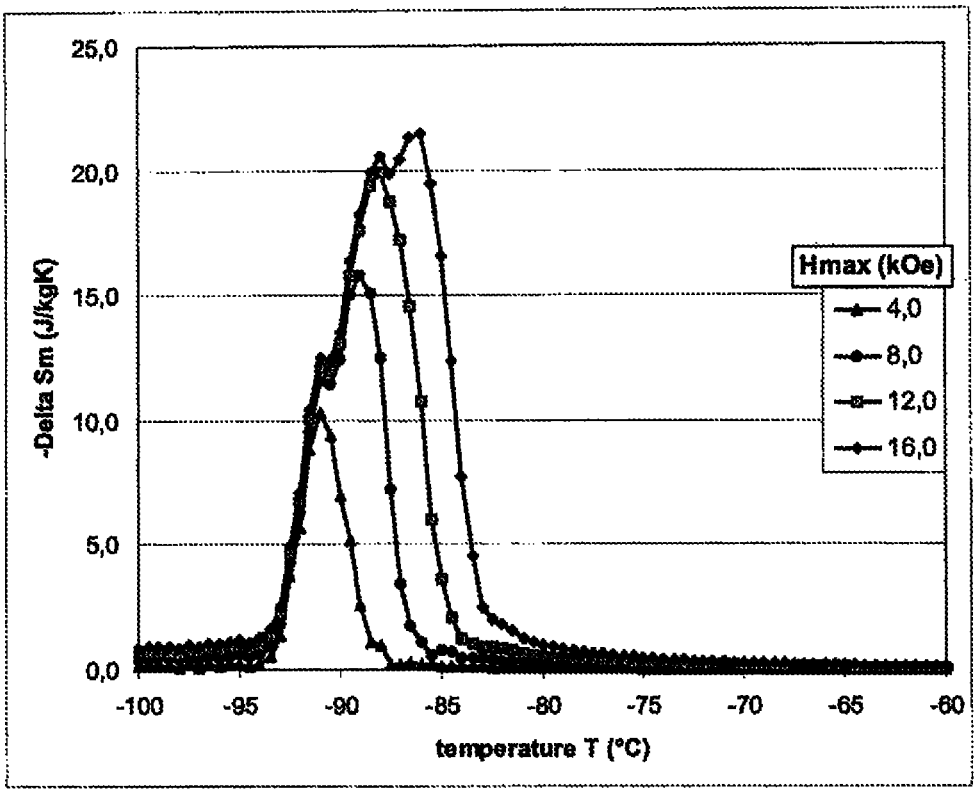
FIG. 7*b* is a graph illustrating the temperature dependence of the entropy change $\Delta S_m$ for the magnetic article of FIG. 7*a*.

This sample was then subjected to a further heat treatment at 1100° C. for 11 hours. The temperature dependence of the polarisation J and the temperature dependence of the entropy change $\Delta S_m$ at different applied magnetic fields in the range 1 kOe to 16 kOe for this sample are illustrated in FIGS. 7*a* and 7*b* respectively.

After a first heat treatment at 1140° C., the maximum entropy change for an applied magnetic field of 12 kOe is around 14 J/kgK, FIG. 6*b*. After a further heart treatment at 1100° C. for 11 hours, the maximum entropy change increases to around 20 J/kgK, FIG. 7*b*.

Reactive sintering can, therefore, be used to manufacture articles or components displaying a magnetocaloric effect directly from a precursor powder mixture comprising a La precursor powder, iron precursor powder and silicon precursor powder by a single press and a single heat treatment. The heat treatment may be carried out at a single temperature or a two stage process may be used where the first and second stages are carried out at different temperatures.

This method is simpler than casting-based fabrication methods since the formation of the magnetocalorically active phase and the formation of the article as a solid sintered body takes place at the same time. In contrast, in the casting methods, the alloy is first cast, then subjected to a heat treatment to homogenize the alloy and form the magnetocalorically active phase, then pulverized, pressed and then given a further heat treatment to sinter the particles of the pre-formed magnetocalorically active phase together to form a sintered body.

Reactive sintering may be carried out at lower temperatures than those used in the casting methods, in particular at temperatures of less than 1150° C., for example at temperatures in the range 1000° C. to 1150° C. This results in a reactive sintered article with a smaller grain size, in particular with an average grain size of less than 20 μm As a result of the smaller grain size, an article with improved mechanical strength and corrosion resistance is provided.

Elemental Additions to the $La(Fe,Si)_{13}$ Phase

FIGS. 8 to 11 illustrate the effect of various additional elements on the Curie temperature, $T_c$, for reactive sintered articles.

Reactive sintering methods have the further advantage that the composition of the precursor powder can be simply and finely adjusted, thereby finely adjusting the composition of the reactive sintered article so as to optimize the properties such as the Curie temperature $T_c$. Further experiments were also carried out to demonstrate that articles comprising $La(Fe, Si)_{13}$-based phases of a variety of compositions may also be manufactured using reactive sintering.

C Additions

In a first embodiment, the effect of C additions was investigated. A precursor powder was fabricated as previously described and C additions in the form of graphite powder of 0.3 wt %, 0.6 wt %, 0.9 wt %, 1.2 wt % and 1.5 wt % added. These powders were pressed as previously described and reactive sintered at 1140° C. for 8 hours to form reactive sintered articles.

Figure 8:
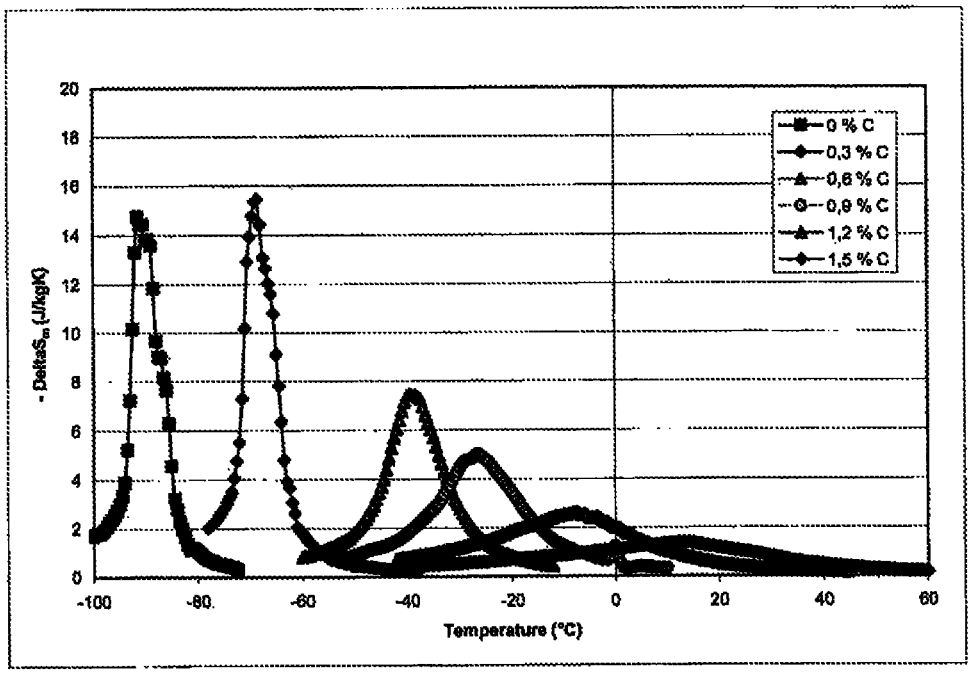
FIG. 8 is a graph illustrating the temperature dependence of the entropy change $\Delta S_m$, for embodiments of the magnetic articles disclosed herein further comprising carbon in the range from 0.3 wt % to 1.5 wt % and reactive sintered at 1140° C. for 8 hours.

FIG. 8 shows a diagram illustrating the temperature dependence of the entropy change $\Delta S_m$ at different applied magnetic fields in the range 1 kOe to 16 kOe for the magnetic articles further comprising carbon in the range from 0.3 wt % to 1.5 wt % for these samples as well as a comparison sample without carbon additions.

FIG. 8 illustrates that the temperature at which the maximum entropy change occurs increases with increasing C content. For the comparison sample, the maximum entropy change occurs at a temperature of around −90° C. This is increased to around −65° C. for 0.3 wt % C, −38° C. for 0.6 wt % C, −25° C. for 0.9 wt % C, and −10° C. for 1.2 wt % C. The maximum entropy change $\Delta S_m$ was observed to decrease for C contents of 0.6 wt % and above.

Figure 9:
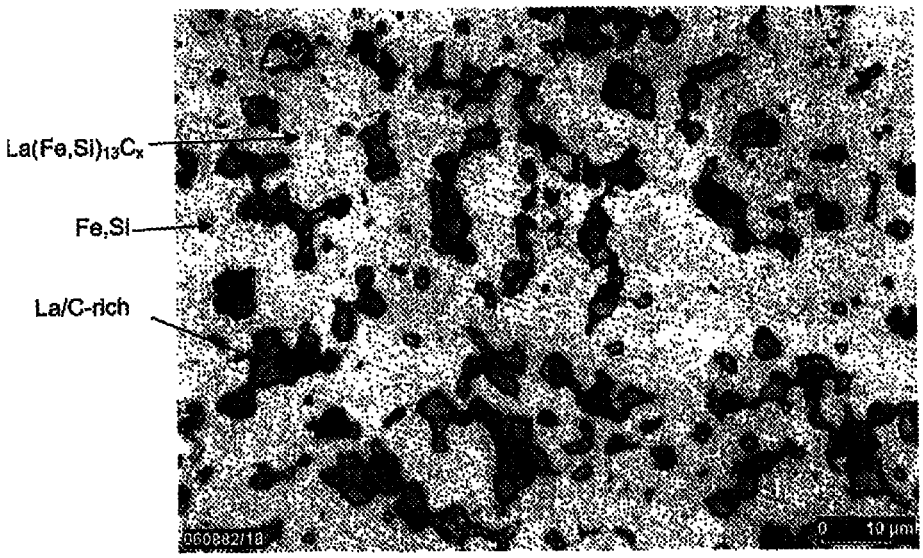
FIG. 9 is a micrograph of a polished cross-section of an embodiment of a magnetic article disclosed herein comprising 1.5 wt % C reactive sintered at 1160° C. for 8 hours.

FIG. 9 shows a micrograph of a polished cross-section of a reactive sintered magnetic article comprising 1.5 wt % C sintered at 1160° C. for 8 hours which illustrates that the article also comprises La and C-rich phases as well as FeSi-rich phases.

C is believed to be accommodated largely interstitially in the crystal structure of the $La(Fe,Si)_{13}$-based phase.

Pr Additions

In a second embodiment, the effect of Pr additions was investigated. A precursor powder was fabricated as previously described and Pr additions of 1.0 wt % and 2 wt % were added. Pr was added in the from of $PrH_x$ as a powder with an average particle size (FSSS) of 4 μm. These powders were pressed as previously described and reactive sintered at 1120° C. for 8 hours to form reactive sintered articles.

Figure 10:
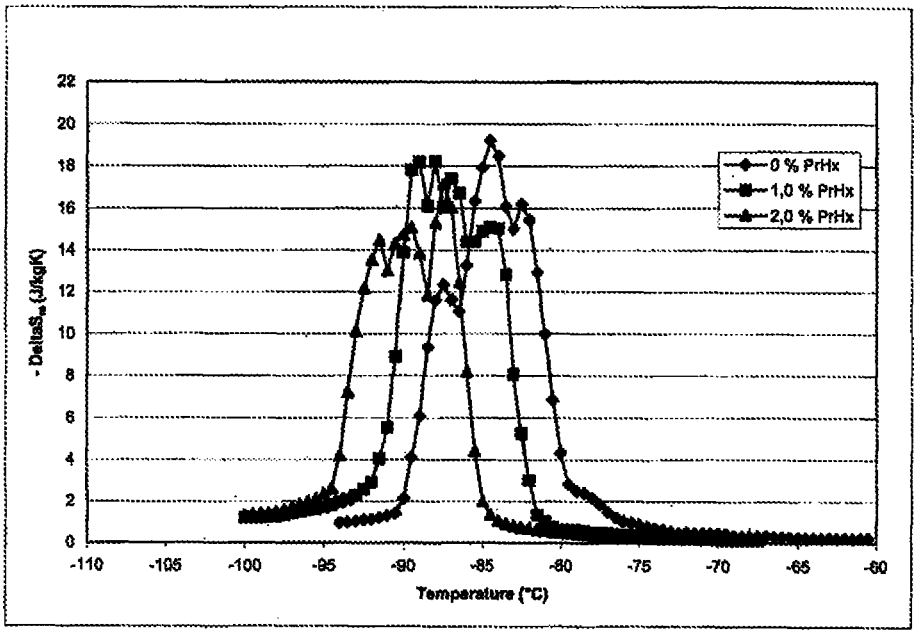
FIG. 10 is a graph illustrating the temperature dependence of the entropy change $\Delta S_m$ for embodiments of the magnetic articles disclosed herein further comprising 1 wt. % Pr and 2 wt % Pr and reactive sintered at 1120° C. for 8 hours.

FIG. 10 shows a diagram illustrating the temperature dependence of the entropy change $\Delta S_m$ at different magnetic fields in the range 1 kOe to 16 kOe for the magnetic articles further comprising 1 wt % Pr and 2 wt % Pr and reactive sintered at 1120° C. for 8 hours as well as a comparison sample without Pr additions. The temperature at which the maximum entropy change occurred was found to decrease slightly with increasing Pr content.

Co Additions

In a third embodiment, the effect of Co additions was investigated. A precursor powder was fabricated as previously described and Co additions of 2.5 wt %, 4.9 wt %, 7.4 wt %, 9.9 wt % and 12.3 wt % added. The Co additions were added to the precursor powder in the form of a fine powder with an average particle size (FSSS) of 1.2 μm. These powders were pressed as previously described and reactive sintered at 1140° C. for 8 hours to form a reactive sintered article.

Figure 11:
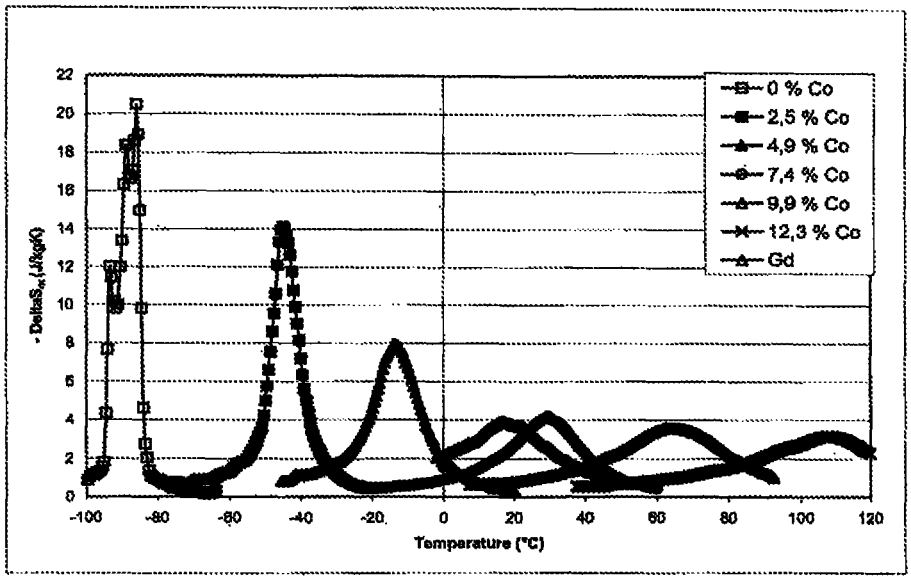
FIG. 11 is a graph illustrating the temperature dependence of the entropy change $\Delta S_m$ for embodiments of the magnetic articles disclosed herein further comprising Co in the range from 2.5 wt % to 12.3 wt % and reactive sintered at 1140° C. for 8 hours.

FIG. 11 shows a diagram illustrating the temperature dependence of the entropy change $\Delta S_m$ at different magnetic fields in the range 1 kOe to 16 kOe for these magnetic articles further comprising Co in the range from 2.5 wt % to 12.3 wt % and reactive sintered at 1140° C. for 8 hours in addition to a comparison sample without Co and a sample of Gd.

The temperature at which the maximum entropy change occurs increases from −90° C. to above room temperature with increasing Co content.

Further Compositions

The reactive sintered article may also be subjected to a further heat treatment in order to introduce atoms from the vapour state into the crystal structure. For example, the article may be heated in a hydrogen-containing atmosphere to introduce hydrogen into the $NaZn_{13}$ crystal structure of the $La(Fe,Si)_{13}$— based phase. Hydrogen is thought to occupy largely interstitial sites in the $NaZn_{13}$ crystal structure. Other volatile or gaseous elements may also be introduced in the same way. For example, the oxygen or nitrogen content of the reactive sintered article may be adjusted in this manner. The effect achieved depends on the element introduced. The introduction of hydrogen results in a increase in $T_c$ for example.

Further Working of Reactive Sintered Articles

The reactive sintered magnetic articles can be used as the active component in a magnetic refrigeration system, for example as a fin in a heat exchanger. The green body can formed so that after the reactive sintering process, the reactive sintered article has dimensions which correspond approximately to, or are nearly exactly those of, the desired shape. It is also possible to carry out a further grinding or polishing step to further refine the form to provide the exact dimensions desired after the reactive sintering process.

If desired, the reactive sintered article can also be provided with an outer protective coating to prevent corrosion as a result of a reaction with the atmosphere or the heat exchange medium in which the article operates. The coating may be a metal coating may be selected to have a high thermal conductivity in order to further improve the heat transfer characteristics of the magnetocalorically active article. The metal coating may be Al, Cu, Sn or Ni.

This coating may be deposited by galvanic deposition which has the advantage that it can be carried out at around room temperature. Galvanic deposition has the further advantage that a three-dimensional form of a more complex nature can be simply coated. Alternatively, dipping and spraying could also be used.

In a further embodiment, one or more channels are provided in one or more surfaces of the reactive sintered magnetic article. The channel or channels increase the surface area of the article and increase the heat transfer from the magnetocalorically active article to the heat exchange medium. These channels may be adapted to direct the flow of the heat exchange medium so as to reduce eddy currents and to lower the flow resistance of the heat exchange medium which further improves heat transfer and the efficiency of the heat exchanger. The channel may be formed by spark cutting, for example, in the reactive sintered article. The channel may also be formed in the green body and, if necessary or desired, further worked after the reactive sintering process.

If an outer protective coating is provided, the channels may be manufactured first before the coating is applied. Depending on the thickness of the coating and the depth of the channel or channels, the channel could be formed only in the coating.

A reactive sintered magnetic article according to one of the embodiments previously described may form part of a composite or a laminate structure which comprises two or more articles which may have essentially the same or different shapes and/or the same or a different $T_c$.

Composite Reactive Sintered Articles

In further embodiments of the invention, an article is provided which comprises a mantle and at least one core. The core or cores may comprise the precursor powder according to one of the embodiments previously described. In further embodiments, the composite article is heat treated and the precursor powder of the core reactive sintered to produce a magnetocalorically active core comprising a $La(Fe,Si)_{13}$— based phase enveloped by the mantle. The article and the process of its manufacture may be considered a type of powder-in-tube process.

This composite may be provided in a form suitable for use as the active component in a magnetic refrigeration system or may be used in combination with further magnetocalorically active composite articles to form laminated articles or composite articles of a more complex shape.

If two or more composite articles are provided, each article may comprise a different Tc which may be provided by adjusting the composition of the $La(Fe,Si)_{13}$-based phase by adjusting the stoichiometry of the precursor powder mixture as previously described.

Figure 12:
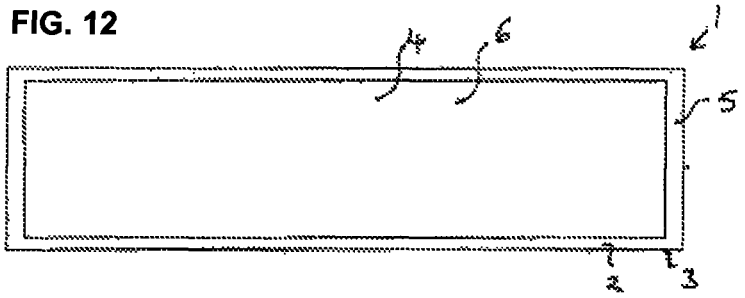
FIG. 12 is a schematic diagram that illustrates a step in the manufacture of a fin for a heat exchanger in which precursor powder is enveloped in a metal mantle to form a precursor composite article.
Figure 13:
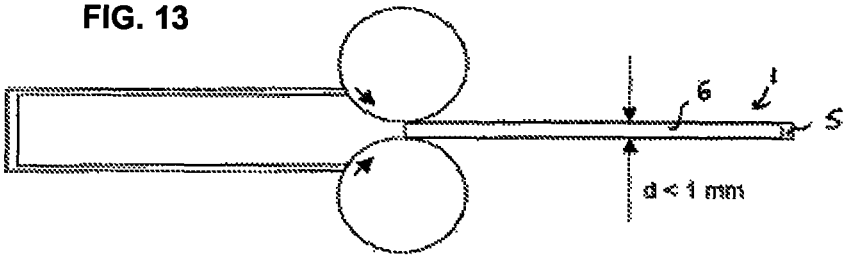
FIG. 13 is a schematic diagram that illustrates the mechanical deformation of the precursor composite article of FIG. 12.
Figure 14:
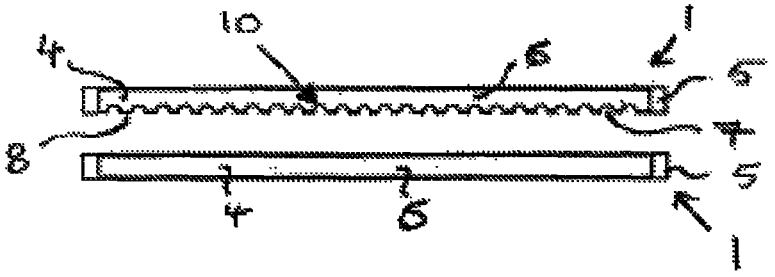
FIG. 14 is a schematic diagram that illustrates the production of a spacer by profile rolling the precursor composite article of FIG. 13.

An embodiment in which the composite article comprises a single core is illustrated in FIGS. 12 to 14.

In an embodiment, illustrated in FIG. 12, a composite article 1 comprising one or more magnetocalorically active $La(Fe,Si)_{13}$— based phases is fabricated by providing an iron mantle 5 and a quantity of precursor powder 4 comprising a lanthanum precursor, and iron precursor and a silicon precursor. The precursor powder 4 may also include further elements such as cobalt, Co, and Pr or other elements as previously described. The various precursor powders are each provided in amount to provide the stoichiometry for the desired $La(Fe,Si)_{13}$— based phase. The precursor powder contains no substantial amount of a magnetocalorically active $La(Fe,Si)_{13}$-based phase.

The components of the precursor powder 4 may be initially provided in the form of hydrides in order that the starting precursor powders may be more effectively milled. In this case, the precursor powder is dehydrogenated at a temperature of less than 1000° C. in a vacuum before the precursor powder 4 is enclosed in the mantle 5.

The precursor powder 4 may be provided as a pressed green body 15 which is then enveloped in the mantle 5 or may be provided as a loose powder.

The precursor powder 4 is arranged in the iron mantle 5 so that the iron mantle or sheath 5 envelops and encloses the precursor powder 4. The edges of the mantle 5 may be welded together to form a closed container. The mantle 5 surrounds a core 6 of the unreacted precursor powder 4.

The mass ratio between the powder core 6 and the iron mantle 5 is preferably at least 4. It is advantageous that the fill factor of the composite article 1 is as high as possible so as to increase the cooling power per unit volume of the composite article 1.

The core 6 comprising the precursor powder 4 may then be densified, as illustrated in FIG. 13, by mechanically deforming the precursor composite article. Conventional mechanical deformation processes such as rolling, swaging and drawing may be used. If the initial composite has a plate-like structure, as illustrated in FIG. 12, rolling can be simply used. If, however, the initial composite has a tubular structure, drawing or swaging may be used, possibly followed by rolling if it is desired that the deformed composite article has a plate-like or tape-like form.

After the powder 4 is packed inside the iron mantle 5, the arrangement may be subjected to a degassing treatment, which may be performed by placing the arrangement in a vacuum, before the mechanical deformation is carried out.

The degassing heat treatment removes air and other volatile components which would otherwise be trapped inside the mantle 5 and may lead to the formation of undesired secondary phases or impurity phases during the reactive sintering process.

Alternatively, the mantle 5 may be sealed around the core 6 and the mechanical deformation may be carried out.

In addition, the mantle may also be provided in the form of a tube, open at one or two ends, or has a flat envelope open on one side or a mantle in the form of a foil may be wrapped around the precursor powder. A single longitudinal seam results which may be sealed by self welding of the mantle during the mechanical deformation process or may be sealed by welding or brazing.

After the mechanical deformation process, if this is performed, the precursor composite article is given a heat treatment to reactive sinter the precursor powder 4 of the core 6 and form the at least one magnetocalorically active $La(Fe,Si)_{13}$-based phase. This heat treatment may be carried out at temperatures, times and under conditions within the ranges previously described.

Since the chemical reaction to form the desired $La(Fe,Si)_{13}$— based phase is carried out after the precursor powder is enveloped by the mantle 5, the mantle 5 should be mechanically and chemically stable under the conditions at which the reaction is carried out.

Preferably, the mantle comprises a metal or an alloy which has a melting point above around 1100° C. Suitable metals may be steel, stainless steel, nickel alloys and iron silicon. Stainless steel and nickel alloys have the advantage that they are corrosion resistance and can provide an protective outer coating for both the precursor powder as well as the reacted $La(Fe,Si)_{13}$— based phase.

The mantle 5 may also comprise two or more layers of differing materials. This can be advantageous in that the inner mantle may be chemically compatible with the precursor material. In this sense, chemically compatible is used to indicate that an undesired reaction does not occur between the material of the mantle 5 and the core 6 so as to move the stoichiometry away from the desired stoichiometry. The outer mantle may be chemically incompatible with respect to the core but may provide mechanical stability or corrosion protection. The outer mantle may be provided in the form of a foil or tube similar to one of the embodiments already described. Alternatively, the outer mantle may be deposited as a coating on the mantle 5.

The thickness of the precursor composite article after the mechanical deformation process may be in the order of one millimeter or less if it is provided in the form of a plate.

In further embodiments not illustrated in the figures, the composite article comprises a mantle and a plurality of cores. The plurality of cores may be provided by packing several composite articles together and enveloping them in a second outer mantle. This new multicore structure may then be subjected to further mechanical deformation steps before a reactive sintering heat treatment is carried out.

Alternatively, or in addition, a multicore structure could be provided initially by stacking together a plurality of precursor green bodies separated by metal alloy sheets. An outer mantle could be provided around this arrangement and the multicore structure mechanically deformed.

The composite article comprising a mantle and one or more cores may be further worked to provide a component having the desired form for heat exchanger if the as manufactured composite is not appropriate.

For example, if a long-length tape or wire is produced, this may be wound into a coil or spool. The coil may have the form of a solenoid coil which may be multilayered or the core may be provided in the form of a flat pancake coil. Several of these pancake coils may be stacked together to provide a cylindrical component.

If plates or plate-like forms are produced, these may be stacked one on top of the other to provide a laminate structure of the desired lateral size and thickness. In all cases, the different layers may be welded or soldered together. The desired lateral form may be provided by stamping the desired shape out of a composite article in the from of a plate or foil.

If however, the assembled article is not subjected to further heat treatment, a glue having the appropriate thermal stability for the application may be used. Since the Curie temperature of these materials and, consequently, the operating temperature of these materials, is around room temperature, conventional glues or resins could be used.

In further embodiments, the surface area of the composite article comprising a mantle 5 and one or more cores is increased by providing one on more channels 7 in one or more surfaces. This can be easily and simply achieved by profile rolling. This embodiment is illustrated in FIG. 14.

The profile rolling may be carried out before or after the reactive sintering process.

In one embodiment, the composite article is subjected to profile rolling so that one surface of the composite article comprises a plurality of generally parallel channels, e.g., grooves 7 separated by a plurality of generally parallel ridges 8.

In further embodiment, the channel 7 or channels are adapted so as to direct the flow of the heat exchange medium when the composite article is mounted in the heat exchanger. This can reduce the flow resistance of the heat exchange medium and improve the efficiency of the heat exchanger.

Further embodiments of the invention relate to a laminated article 9 which comprises two or more composite articles 1, each comprising a mantle 5 and one or more cores 6.

Figure 15:
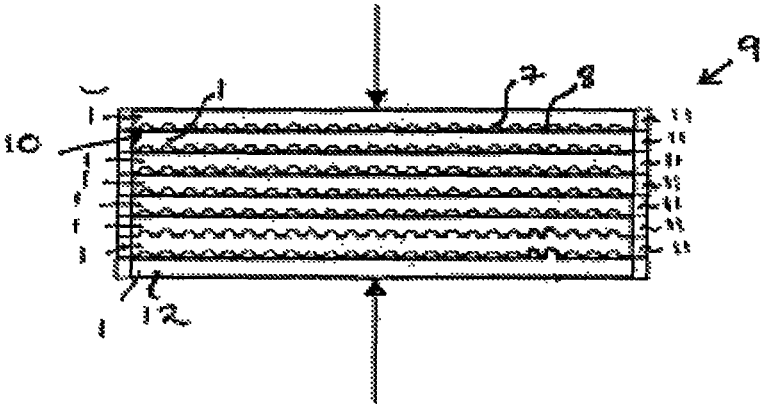
FIG. 15 is a schematic diagram that illustrates the assembly of a laminate article comprising a plurality of the precursor composite articles illustrated in FIG. 14.

FIG. 15 illustrates the assembly of a laminate article 9 comprising a plurality of the precursor composite articles 1 illustrated in FIG. 14.

In the embodiment illustrated in FIG. 15, the laminated article 9 comprises at least one spacer 10 which is positioned between adjacent layers 11 of the laminated article 9. The spacer 10 provides gaps in the laminated article 9 through which the heat exchange medium can flow thus increasing the contact area between the heat exchange medium and the laminated article 9 and improving the heat transfer. The spacer 10 may also be provided in a form adapted to provide a series of channels 7 through which the heat exchange medium can flow. These channels 7 may be further adapted to direct the flow of the heat exchange medium so as to reduce flow resistance.

In a particular embodiment, the spacer 10 is provided as an integral part of the composite article 1. An example of this embodiment is an article comprising one or more channels 7 in the surface, for example a plurality of essentially parallel grooves 7 and ridges 8 as previously described and as illustrated in FIG. 14.

In the particular embodiment illustrated in FIG. 15, the laminate 9 comprises seven layers 11 of the composite article 1, each comprising a plurality of grooves 7 produced by profile rolling in one surface. These composite articles 1 are stacked with the side comprising the grooves 7 facing towards a base plate 12 which is free from grooves. The base plate 12 is also a composite article 1 comprising a mantel 5 and core 6 comprising a $La(Fe,Si)_{13}$— based phase. Thus, a spacer 10 in the form of a plurality of channels 7 is provided between adjacent layers 11 of the laminate structure 9. It will be understood that different arrangements, numbers of layers, etc. are also possible.

The laminate structure 9 may be assembled before the reactive sintering treatment and may be kept under mechanical pressure during the reaction sintering.

Alternatively, the laminate structure may be assembled after the reaction sintering treatment and a plurality of composite articles comprising the reactive sintered magnetocalorically active $La(Fe,Si)_{13}$— based phase may be stacked together, and optionally soldered together, to form a laminate 9.

In further embodiment, the laminated article 9 is stacked so that the grooves 7 of one layer 11 are positioned orthogonally to the grooves 7 of the adjacent layer 11 and so on through the stack. This embodiment can be used, e.g. to provide a fin of a heat exchanger with a cross type arrangement. One direction may be used as the inflow and the other direction as the outflow.

In further embodiment disclosed herein, the spacer is provided in the form of an additional element positioned between adjacent composite articles 1 of the laminated structure 9.

The spacer may be provided as a former. The former may be a series of posts or rods positioned between adjacent layers 11. Alternatively, if a long-length tape or wire is provided, the former may be provided in the form of a wheel having a plurality of perpendicularly arranged pins arranged at intervals from the centre to the periphery of the wheel around which the tape or wire may be wound.

Figure 16:
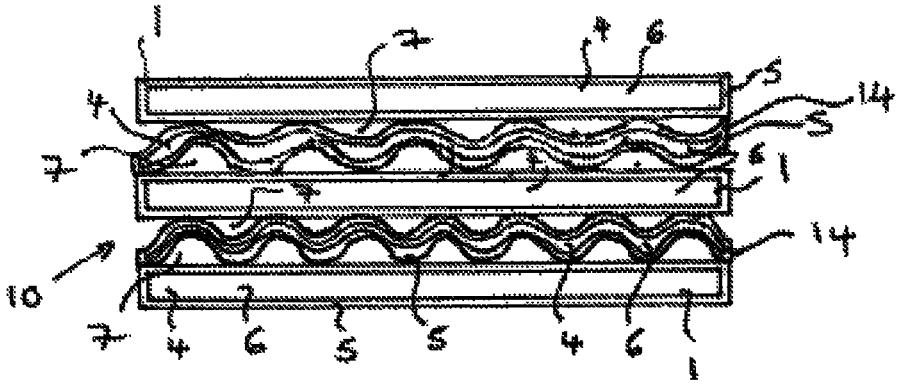
FIG. 16 is a schematic diagram that illustrates a laminated article according to a second embodiment in which the spacer is provided as an additional element.

In further embodiment, illustrated in FIG. 16, the laminated article 13 comprises a spacer 10 which is formed by a corrugated tape 14. The laminated article 13, therefore, comprises alternating layers of a flat composite article 1 and a corrugated tape 14 as having a shape similar to that used in the structure of cardboard. The corrugated tape 14 may also provide channels 7 which are adapted to direct the flow of the heat exchange medium as already described. In the embodiment illustrated in FIG. 16, the laminated article 13 comprises two spacers 10 in the form of corrugated tapes 14 and three flat composite articles 1. However, any number of layers may be provided. The outermost layers of the stack may also comprise corrugated tapes 14.

In further embodiment, the corrugated tape 14 comprises at least one magnetocalorically active $La(Fe,Si)_{13}$— based phase. In other words, the spacer 10 in the form of a corrugated tape 14 may be provided by a corrugated composite article 1 comprising a mantle 5 and at least one core 6 according to one of the embodiments previously described. This embodiment has the advantage that the laminate structure 13 is strong and the thickness of the tape 14 providing the corrugated spacer 10 and the flat tapes 1 may be varied depending on the cross-sectional area and size of the channels 7 desired.

The use of an additional spacer 10 has the advantage that it can be more simply integrated into a coil type structure by co-winding a flat tape and corrugated tape. A co-wound pancake coil or solenoid coil can also be fabricated in a similar way.

The corrugated tape 14 may be fabricated by rolling the tape, or composite article 1 in tape form, between two meshed cogs for example.

The invention having been described by reference to certain specific embodiments thereof, it will be understood that these embodiments are intended to illustrate, but not limit, the scope of the appended claims.

What is claimed is:

1. A method of manufacturing a reactive sintered magnetic article comprising:

providing a precursor powder mixture comprising a La precursor, an Fe precursor and Y precursor, wherein Y is one or more of Si, Al, As, Ga, Ge, Sn, and Sb, each in an amount to provide the stoichiometry for a $(La_{1-a}M_a)(Fe_{1-b-c}Tb\ Y_c)_{13-d}$ magnetocaloric phase and the precursor powder mixture containing no substantial amount of a $(La_{1-a}M_a)(Fe_{1-b-c}Tb\ Y_c)_{13-d}$ phase, wherein M is one or more of Ce, Pr, and Nd, and T is one or more of Co, Ni, Mn, and Cr; and wherein $0 \le a \le 0.9$, $0 \le b \le 0.2$, $0.05 \le c \le 0.2$, and $-1 \le d \le +1$, wherein the providing of the precursor powder mixture comprises: mixing the precursors and reducing the average particle size of the precursors to form the precursor powder mixture, and providing of the precursor powder mixture further comprises loading at least one precursor with hydrogen before the mixing of the precursors, compacting the precursor powder mixture to form a green body, reactive sintering the green body at a temperature of between 1000° C. and 1150° C. for a time between 2 and 24 hours to form a reactive sintered article having at least one phase having a composition of $(La_{1-a}M_a)(Fe_{1-b-c}\ T_b\ Y_c)_{13-d}$, and wherein said reactive sintering of the green body is conducted to provide the reactive sintered article having a density of at least 90% of the theoretical density.

2. The method according to claim 1, wherein the La precursor and Y precursor are provided as a binary precursor, wherein the binary precursor has been fabricated by book-molding or strip casting.

3. The method according to claim 1, wherein the La precursor and Fe precursor are provided as a binary precursor, wherein the binary precursor has been fabricated by book-molding or strip casting.

4. The method according to claim 1, wherein said reactive sintering is carried out as a two-stage reactive sintering, wherein in a first stage, reactive sintering is conducted under vacuum and in a second stage, reactive sintering is conducted in inert gas.

5. The method according to claim 4, wherein said reactive sintering is carried out such that at least 50% of the total reactive sintering time is carried out under vacuum.

6. The method according to claim 5, wherein said reactive sintering is carried out such that at least 80% of the total reactive sintering time is carried out under vacuum.

7. The method according to claim 1, wherein said reactive sintering is carried out as a two stage reactive sintering process, comprising a first stage, wherein the reactive sintering temperature is about 0° C. to about 100° C. higher than the reactive sintering temperature in a second stage.

8. The method according to claim 7, wherein the first stage is carried out for up to 12 hours and wherein the total reactive sintering time is 2 hours to 24 hours.

9. The method according to claim 1, wherein the reactive sintering process is conducted such that the average grain size of the reactively sintered article is less than 20 μm.

10. The method according to claim 1, further comprising introducing H, B, C and/or O during the sintering process.

11. The method according to claim 1, further comprising introducing H, B, C and/or O after the sintering process.

12. The method according to claim 11, further comprising subjecting the reactively sintered article to a further treatment in a H, B, C and/or O containing atmosphere.

13. The method according to claim 12, wherein the further treatment is carried out at a temperature from 20° C. to 500° C. at a pressure of 1 mbar to 10 bar, and for a time of 0.1 to 100 hours.

14. The method according to claim 1, further comprising introducing at least one channel into a surface of the reactive sintered magnetic article after the production of the reactive sintered magnetic article.

15. The method according to claim 14, wherein the introducing of the at least one channel comprises sawing or spark cutting.

16. The method according to claim 1, further comprising coating the sintered magnetic article with a protective layer.

17. The method according to claim 1, wherein the La precursor is a La hydride.

18. The method according to claim 1, wherein the Fe precursor is carbonyl iron.

19. The method according to claim 1, wherein the La precursor and the Fe precursor are provided as a binary precursor.

20. The method according to claim 1, wherein the La precursor and the Y precursor are provided as a binary precursor.

21. The method according to claim 1, wherein, wherein M is Ce and $0 \leq a \leq 0.9$.

22. The method according to claim 1, wherein M is one or more of the elements Pr and Nd and $0 \leq a \leq 0.5$.

23. The method according to claim 1, further comprising $X_e$ wherein $0 \leq e \leq 3$, and wherein X is one or more of the elements H, B, C, N, Li and Be.

24. The method according to claim 1, wherein the average particle size of the powder is less than 20 μm.

25. The method according to claim 24, wherein the average particle size of the powder is less than 10 μm.

26. The method according to claim 25, wherein the average particle size of the powder is less than 5 μm.

* * * * *